US007111423B2

(12) United States Patent
Lizotte et al.

(10) Patent No.: US 7,111,423 B2
(45) Date of Patent: Sep. 26, 2006

(54) METHOD AND APPARATUS FOR READING FIREARM MICROSTAMPING

(75) Inventors: Todd E. Lizotte, Manchester, NH (US); Orest Ohar, Hooksett, NH (US)

(73) Assignee: Identification Dynamics, LLC, Pottstown, PA (US)

( * ) Notice: Subject to any disclaimer, the term of this patent is extended or adjusted under 35 U.S.C. 154(b) by 2 days.

(21) Appl. No.: 10/427,513

(22) Filed: May 1, 2003

(65) Prior Publication Data

US 2006/0174531 A1 Aug. 10, 2006

Related U.S. Application Data

(63) Continuation-in-part of application No. 10/372,459, filed on Feb. 21, 2003, now Pat. No. 6,833,911, which is a continuation-in-part of application No. 10/232,766, filed on Aug. 29, 2002, now Pat. No. 6,886,284, and a continuation-in-part of application No. 10/183,806, filed on Jun. 26, 2002, now Pat. No. 6,653,593, which is a continuation-in-part of application No. 09/540,366, filed on Mar. 31, 2000, now Pat. No. 6,420,675, which is a continuation-in-part of application No. 09/514,084, filed on Feb. 28, 2000, now Pat. No. 6,310,701.

(60) Provisional application No. 60/315,851, filed on Aug. 29, 2001, provisional application No. 60/158,478, filed on Oct. 8, 1999.

(51) Int. Cl.
*F41A 9/53* (2006.01)

(52) U.S. Cl. ..... 42/1.01; 102/430

(58) Field of Classification Search ..... 42/1.01

See application file for complete search history.

(56) References Cited

U.S. PATENT DOCUMENTS 4,035,942 A 7/1977 Wiczer
4,175,346 A 11/1979 Zemsky ..... 42/78
4,326,824 A 4/1982 Lasermann et al. ..... 409/132

(Continued)

FOREIGN PATENT DOCUMENTS

DE 3830903 A1 * 3/1990

(Continued)

OTHER PUBLICATIONS

The Telegraph: Londonderry, N.H., Firm Develops Technology for Firearm Identification, Oct. 18, 2002.*

(Continued)

*Primary Examiner*—Troy Chambers
(74) *Attorney, Agent, or Firm*—Davis & Bujold, P.L.L.C.

(57) ABSTRACT

An indicia for marking on an object, such as a cartridge case, for representing selected information, such as identification indicia identifying the firearm that discharged the cartridge, and methods and apparatus for generating, imprinting and reading the identification indicia. An indicia includes a multi-dimensional array of encoded marks, including encoded marks determined by spectral encoding variables representing the selected information wherein each spectral variable is spectrally distinguishable from others of the spectral variables representing variables, and an encoded pattern of the encoded marks is determined by algorithmic transformation of the selected information. An indicia may also include hologram related artwork. An indicia may be an encoded hologram multi-dimensional barcode, an encoded hologram or an encoded concentric circular barcode and may be formed of a single indicia or as an array of indicia.

7 Claims, 14 Drawing Sheets

U.S. PATENT DOCUMENTS

| | | | | |
|---|---|---|---|---|
| 4,348,253 | A | 9/1982 | Subbarao et al. | 156/643 |
| 4,473,737 | A | 9/1984 | Anthony | 219/121 LL |
| 4,532,402 | A | 7/1985 | Overbeck | 219/121 LU |
| 4,681,452 | A | 7/1987 | Watanabe | 356/375 |
| 4,959,119 | A | 9/1990 | Lantzer | 156/644 |
| 5,108,785 | A | 4/1992 | Lincoln et al. | 427/96 |
| 5,126,648 | A | 6/1992 | Jacobs | 318/640 |
| 5,157,235 | A | 10/1992 | Okumura et al. | 219/121.68 |
| 5,257,091 | A | 10/1993 | Caicedo, Jr. et al. | 356/358 |
| 5,293,025 | A | 3/1994 | Wang | 219/121.71 |
| 5,481,407 | A | 1/1996 | Smith et al. | 359/742 |
| 5,502,914 | A | 4/1996 | Moon | 42/69.02 |
| 5,509,553 | A | 4/1996 | Hunter, Jr. et al. | 216/13 |
| 5,523,543 | A | 6/1996 | Hunter, Jr. et al. | 219/121.62 |
| 5,552,574 | A | 9/1996 | Merlin et al. | 219/121.69 |
| 5,571,429 | A | 11/1996 | Smith et al. | 219/121.68 |
| 5,593,606 | A | 1/1997 | Owen et al. | 219/121.71 |
| 5,614,114 | A | 3/1997 | Owen | 219/121.66 |
| 5,633,735 | A | 5/1997 | Hunter, Jr. et al. | 359/15 |
| 5,646,365 | A * | 7/1997 | Collier | 102/501 |
| 5,685,100 | A | 11/1997 | Atchison | 42/1.01 |
| 5,702,662 | A | 12/1997 | Smith et al. | 264/400 |
| 5,737,122 | A | 4/1998 | Wilt et al. | 359/436 |
| 5,758,446 | A | 6/1998 | Atchison | 42/78 |
| 5,808,272 | A | 9/1998 | Sun et al. | 219/121.68 |
| 5,811,754 | A | 9/1998 | Nakatani et al. | 219/121.83 |
| 5,841,099 | A | 11/1998 | Owen et al. | 219/121.69 |
| 5,847,960 | A | 12/1998 | Cutler et al. | 364/474.29 |
| 5,894,530 | A | 4/1999 | Wilt | 382/312 |
| 5,920,973 | A | 7/1999 | Kosmowski | 29/26 A |
| 5,946,414 | A | 8/1999 | Cass et al. | |
| 5,984,079 | A | 11/1999 | Garcia | 198/397.02 |
| 5,990,444 | A | 11/1999 | Costin | 219/121.69 |
| 5,997,223 | A | 12/1999 | Kosmowski | 408/124 |
| 6,022,905 | A | 2/2000 | Harris et al. | 522/2 |
| 6,086,204 | A | 7/2000 | Magnante | 351/212 |
| 6,229,786 | B1 | 5/2001 | Miyamoto et al. | |
| 6,420,675 | B1 * | 7/2002 | Lizotte et al. | 219/121.7 |
| 6,462,302 | B1 | 10/2002 | Grow | 219/121.68 |
| 6,886,284 | B1 * | 5/2005 | Lizotte | 42/1.01 |
| 2004/0200208 | A1 * | 10/2004 | Doiron et al. | 42/1.01 |

FOREIGN PATENT DOCUMENTS

| | | |
|---|---|---|
| FR | 2683064 A1 * | 4/1993 |
| IT | 270630 | 6/1930 |

OTHER PUBLICATIONS

Discover: Bullet with a name on it, (vol. 20, Iss. 11) Nov. 1999.*

Vainos, N.A., S. Mailis, S. Pissadakis, L. Boutsikaris, P.J.M. Parmiter, P. Dainty and T. J. Hall, "Excimer laser use for microetching computer-generated holographic structures," Applied Optics, vol. 35, No. 32, Nov. 10, 1996, pp. 6304-6319.

* cited by examiner 114,114EC

METHOD AND APPARATUS FOR READING FIREARM MICROSTAMPING

This application is a continuation in part of and claims benefit of U.S. patent application Ser. No. 10/372,459 filed Feb. 21, 2003, now U.S. Pat. No. 6,833,911 which in turn is a continuation in part of U.S. patent application Ser. No. 10/232,766 filed Aug. 29, 2002, now U.S. Pat. No. 6,886,284 which in turn claims benefit of provisional patent application Ser. No. 60/315,851 filed Aug. 29, 2001, and is a continuation-in-part of and claims benefit of patent application Ser. No. 10/183,806 filed Jun. 26, 2002, now U.S. Pat. No. 6,653,593, which is a continuation-in-part of and claimed benefit of patent application Ser. No. 09/540,366 filed Mar. 31, 2000, now U.S. Pat. No. 6,420,675 B1, which is a continuation-in-part of and claimed benefit of patent application Ser. No. 09/514,084 filed Feb. 28, 2000, now U.S. Pat. No. 6,310,701 B1, which claimed benefit of provisional Ser. No. 60/158,478 filed Oct. 8, 1999.

FIELD OF THE INVENTION

The present invention relates to the identification of expended firearms cartridges and, in particular, to improved indicia for identifying a firearm that is the source of an expended cartridge and an improved apparatus for reading identifying indicia marked on a fired cartridge.

BACKGROUND OF THE INVENTION

Mechanical forensics and ballistics investigations are undertaken in crime investigations, accident reconstructions or other situations in which one or more weapons have been discharged and it is frequently essential to reliably establish an identification of a firearm that fired a given cartridge.

It is well known that bullets and cartridge cases that have been fired from a firearm will bear markings from contact between the bullets or cartridge cases and the surfaces of the firearm with which the bullets and cartridges come into contact. For example, the rifling of the barrel will emboss rifling and other marks on a bullet, and the firing pin, extractor, interior of the breach and face of the bolt will leave markings on the cartridge case. Certain such markings are general to a given type, manufacturer or model of firearm, and may this aid in identifying a firearm, while others are unique to each firearm and may thereby be used to identify a given firearm.

Firearms experts have frequently been able to compare the markings on cartridge cases and bullets, which are traditionally referred to as "scratches and dings" or "ballistic finger prints", with comparable markings made by a suspect firearm on a test bullet or cartridge casing, and have frequently been able to determine whether a specific firearm fired a given bullet or cartridge casing. In addition, there exist, for example, databases of "ballistic finger prints" or "scratch and ding" images of bullets and cartridges recovered from crime scenes, which may be subsequently used to match a firearm to a given crime scene by matching samples of fired cartridges and bullets with the archived "ballistic finger prints" or "scratch and ding" images.

Ballistic finger prints and scratch and ding markings, however, while traditionally the most useful and most used for identifying a given, specific firearm, are, however, pseudo-repeatable and largely random and non-specific in nature. That is, a cartridge case may be damaged in any of a number of ways before it is recovered for examination, and a bullet is often severely fragmented or deformed when it strikes an object, thereby obscuring the ballistic finger print or scratch and ding evidence on the bullet or cartridge case. In addition, the identification of a spent cartridge case or filed bullet to a specific firearm requires access to the firearm itself, either for direct examination or to fire test bullets and cartridge cases for comparison with the cartridge cases or bullets held in evidence. The firearm itself is also subject to influences between the time of firing a cartridge and bullet and the comparison of the markings on the cartridge or bullet to later fired test cartridges and bullets that may alter the markings made by it on cartridges and bullets. For example, the surfaces of a firearm that impose markings on a bullet or cartridge are subject to wear, corrosion, abrasion and intentional alterations, such as grinding, etching or filing of surfaces and the replacement of original parts with different parts.

In addition, investigators often have limited evidence to work with in order to determine the facts related to the situation at hand, such as when the suspect firearm is unavailable, missing, unrecoverable, damaged or intentionally altered or in instances in which numerous weapons were discharged. For example, it is very common for the perpetrator of a shooting to take a firearm away with him after committing a crime, and often the only evidence left behind is the discharged bullets themselves, if they can be found and are in adequate condition for examination, and spent cartridge cases, if the cartridge cases are available and in condition for examination. Therefore, while scratches, marks and/or other indicia on a spent bullet or cartridge case can assist an investigator with connecting the spent cartridge or bullet with a given firearm, the identification usually requires possession of the firearm itself, for comparison purposes, is often difficult even when the firearm is available.

Currently, such forensic investigations are expensive and time consuming and require personal training and sophisticated equipment that not every law enforcement department has or can afford.

A concept referred to as "Ballistic Tagging", however, may be used to mark cartridges or bullets or both with specially encoded geometric shapes, holograms, alphanumeric codes, barcodes and other specific coding techniques which are not random and are which are completely repeatable and which are unique to each firearm. Such methods would be more reliable and less expensive and time consuming than traditional methods, and would not require the costly apparatus, imperfect imaging algorithms, image acquisition technical problems, non-standardized procedures and cross jurisdictional procedures and data bases used to store and share "ballistic finger prints" or "scratch and ding" images.

There are currently available a variety of systems for forming or micro-engraving images, shapes or symbols in or on an surface of a component of a firearm that contacts a bullet or cartridge case in such a manner as to permit the imposition of an identifying indicia on a bullet or cartridge case. Examples include such firearm surfaces as the face of a firing pin, the interior of the chamber or barrel of a firearm, or a surface of an extractor or loading mechanism. Any firearm surface coming into contact with a cartridge case with sufficient force or pressure, for example, can result an image, shape of symbol being embossed or otherwise marked on a surface of the cartridge by the normal operation of the firearm, such as the loading, firing or ejection of the cartridge. Such images, shapes or symbols, hereafter referred to generally as "images" or "indicia", may take many forms, including abstract symbols or brands, letters or numbers, and so on, and are typically formed of raised or indented areas of a surface, such as holes, vias, blind vias or some other form of surface indentation, raised areas formed by etching or machining away of surrounding surfaces, or any combination thereof.

As a result, fired bullets or cartridge cases or both may be left with markings uniquely identifying the firearm from which they were fired as a result of forced contact between the bullets or cartridge cases and metal parts in the firearm bearing such identifying images. Such parts of a firearm may include, for example, an interior face of the chamber, bolt or barrel or an engraved "marker" embedded in or mounted on such a surface, and may be unique to given firearm by the engraving of an image unique to the firearm during manufacture or as a result of a subsequent refitting or retrofitting.

The advantages of such marking of bullets and cartridges can be realized, however, only if there exist suitable identifying indicia and methods, suitable apparatus for simply, inexpensively and reliably imprinting and reading the markings, and suitable apparatus for correlating the markings on a bullet or cartridge with a given firearm.

It is, therefore, an object of the present invention to simplify and therefore to improve the process of fired cartridge and bullet imaging and analysis, to eliminate the need for complex image algorithms, to reduce the chances of human error, and to eliminate at least some of the need for mapping "scratches and dings" and "ballistic finger prints" of fired cartridges and bullets.

SUMMARY OF THE INVENTION

The present invention is directed to an indicia for marking on an object, such as a cartridge case, for representing selected information, such as identification indicia identifying the firearm that discharged the cartridge, and to methods and apparatus for generating, imprinting and reading the identification indicia.

An indicia of the present invention includes a multi-dimensional array of encoded marks, including encoded marks determined by spectral encoding variables representing the selected information wherein each spectral variable is spectrally distinguishable from others of the spectral variables representing variables, and an encoded pattern of the encoded marks determined by algorithmic transformation of the selected information.

The indicia may be an encoded hologram multi-dimensional barcode, an encoded hologram or an encoded concentric circular barcode. A spectral encoding variable may be a wavelength of radiation used in encoding a hologram or a working distance of a hologram and each encoding spectral variable has a unique effect in determining the encoded pattern of marks, and the selected information may be encoded by one of a binary phase Fourier, DOE, CGH, Lohmann, Lee, Fourier, Fraunhofer, Fresnel and kinoform type of hologram encoding algorithm and an algorithm related artwork may be conjoined with the encoded pattern An encoded concentric circular barcode comprises an array of concentric ring patterns wherein each ring pattern is a circular based intensity encoding of a corresponding information item.

An indicia of the present invention may be formed on a surface of an object by deposition of a material on the surface, imprinted in a marked surface of an object by physical impact of a marking indicia that is an inverse image of the indicia or formed on a surface of an object by removal of selected areas of surface material representing an image of the indicia. An indicia may be comprised of a plurality of spectrally distinguishable layers superimposed on a surface of an object wherein a layer of the indicia is formed in a surface material of the object by one of removal of selected areas of the surface material and by physical impact of a marking indicia that is an inverse image of the indicia.

A marking apparatus may be comprised of an array of marking elements distributed on a surface contacting a surface of the object wherein each marking element has a central striking face bearing a marking indicia, so that a representation of at least one marking indicia is imprinted on the surface of the object as an identification indicia when the surface bearing the array of marking elements contacts the surface of the object. Each marking element may be a marking boss wherein each marking boss is a convex protrusion from the surface bearing the array of marking elements and includes a centrally located striking surface bearing a marking indicia. In other embodiments, each marking element may be a marking dimple wherein each marking dimple is a concave depression in the surface bearing the array of marking elements and each marking dimple includes a centrally located striking surface bearing a marking indicia. Also, the object to be marked may be a cartridge case and the surface bearing the array of marking elements is a surface of a firearm contacting a surface of the cartridge case.

The object upon which an indicia may be formed may be a cartridge case and the marking indicia may be located on a marking surface of a firearm, wherein the marking indicia may be formed in the marking surface or in an impact face of a marking insert embedded in the marking surface.

An encoded multi-dimensional indicia marked on an object may be read by viewing the encoded multi-dimensional indicia according to at least one spectral encoding variable, wherein each spectral encoding variable corresponds to a spectral encoding variable employed in creating the encoded multi-dimensional indicia, reading the encoded pattern representing a multi-dimensional array of encoded marks represented the selected information, and decoding the encoded pattern of encoded marks with an inverse algorithmic transform of an algorithmic transformation employed in generating the encoded pattern from the selected information. At least one spectral encoding variable may a selected spectral illumination, and the viewing the encoded multi-dimensional indicia according to a spectral encoding variable may include viewing the indicia with a corresponding filter.

A self-contained imaging and image capture apparatus for reading an encoded multi-dimensional identification indicia marked on a cartridge case includes a specimen port having therein a mounting device for receiving and holding a cartridge case and a viewing mechanism including an imaging mechanism having a viewing axis substantially perpendicular to an indicia bearing surface of a cartridge for obtaining images of an encoded indicia thereon. The apparatus further includes a spectral illuminator for illuminating the indicia bearing surface of the cartridge case with at least one spectral encoding variable according to a corresponding encoding process, wherein each spectral encoding variable corresponds to a spectral encoding variable employed in creating the encoded indicia. An image capture mechanism includes a focusing mechanism for automatically adjusting the focus of the image of an indicia on the indicia bearing surface of the cartridge and for capturing at least one spectrally illuminated image of an indicia on the indicia bearing surface of the cartridge case and a captured image includes an encoded pattern representing a multi-dimensional array of encoded marks represented the selected information. The apparatus also includes an image decoding mechanism for decoding the encoded pattern of encoded marks with an inverse algorithmic transform of an algorithmic transformation employed in generating the encoded pattern from the selected information.

BRIEF DESCRIPTION OF THE DRAWINGS

The invention will now be described, by way of example, with reference to the accompanying drawings in which.

DESCRIPTION OF THE PREFERRED EMBODIMENTS

A. Introduction

The following will first discuss the elements and operation of a typical firearm, cartridge and bullet, by way of a general introduction to parts and operations of a firearm in imposing identifying indicia on bullets or cartridge cases and to establish common definitions and points of reference. The following will then provide an introduction to the methods and apparatus for embossing or imprinting identifying indicia by a firearm on a cartridge case or bullet, following by a discussion and description of a laser system for generating or providing, on a part of a firearm, the "micro-engraving" or "micro-stamping" tool or image necessary to emboss or stamp an identifying indicia or a cartridge case or bullet.

The following will then described presently preferred embodiments of the invention, including presently preferred forms of identifying indicia and a method and apparatus for reading and identifying such indicia.

B. General Descriptions of Firearms and Cartridges and the Imprinting of Indicia by the Mechanisms of a Firearm As discussed above and as will be described in the following, the present invention is directed to a method and apparatus for forming surface markings forming identifying indicia on an interior surface of a firearm, such as a breech, a firing pin, a cartridge extractor or a loading mechanism, to preferred types of indicia, and to a method and apparatus for reading and identifying such indicia when stamped or otherwise marked on a cartridge case, for example, by operation of the firearm. In particular, the present invention may be employed to form, read and identify a desired unique bar code, matrix, an alpha numeric code, or any desired identifying indicia on a surface of a firearm or on the surface of a cartridge case or bullet fired from the firearm and, in particular, a hologram indicia as described in the following.

Figure 1:
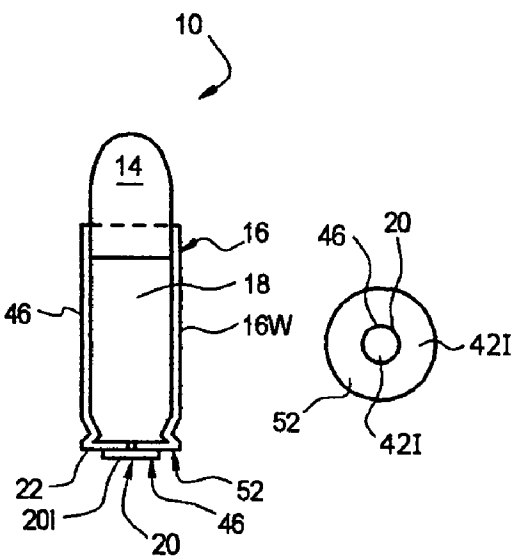
FIG. 1 is a diagrammatic representation of a round of ammunition.

First considering the general structures, mechanisms and operations of cartridges, bullets and firearms that facilitate the embossing or imprinting of an identifying indicia onto a cartridge case of bullet, the definitions established in the following discussions will be used throughout the following descriptions. Accordingly, and as illustrated in FIG. 1, a Round 10 of ammunition includes a Bullet 14 mounted in the end of a Cartridge Case 16 containing a Propellant Charge 18 and having a Primer 20 in the Base 22 of the Cartridge Case 16. As is well known, a firearm firing pin strikes and ignites Primer 20, which in turn ignites Propellant Charge 18, and the combustion of Propellant Charge 18 generates hot gases at high pressures that propel the Bullet 14 out of the barrel of the firearm.

Figure 2:
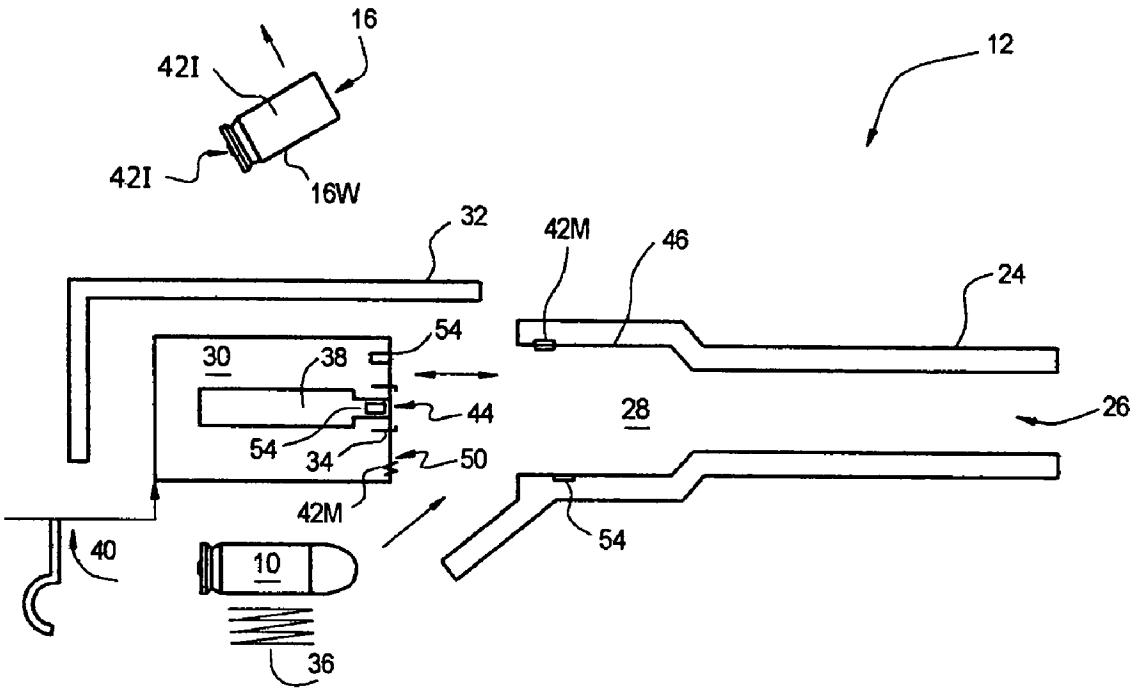
FIG. 2 is a diagrammatic representation of a firearm.

Referring to FIG. 2, a Firearm 12 generally includes a Barrel 24 having a Muzzle 26 from which the Bullet 14 is expelled and, at the opposite end, a Chamber 28 for receiving and holding a Round 10 before and during the firing of the Round 10. The Round 10 is secured in Chamber 28 for firing by a Bolt 30 that moves forwards and backwards in Breach 32 to load successive Rounds 10 into the Chamber 28 and to extract and eject fired Cartridge Cases 16 from the Chamber 28 and Breach 32. Bolt 30 will typically include an Extractor 34 mechanism that engages the Cartridge Case 16 to extract and eject the Cartridge Case 16 and a Loading Mechanism 36 will typically be associated with the Breach 32 to feed successive Rounds 10 into the Breach 32 and to Bolt 30 to be loaded into Chamber 28 by Bolt 30. Bolt 30 will also include a Firing Pin 38, which is usually spring loaded and which is released at the appropriate point in the operations of Firearm 12 by Trigger Mechanism 40 to strike and ignite the Primer 20 of a Round 10 in Chamber 28. As described, the Primer 20 will in turn ignite Propellant Charge 18 to drive Bullet 14 down Barrel 24 and out Muzzle 26. Forces generated by the firing of Round 10, such as gas pressure in Barrel 24 or against the interior base of Cartridge Case 16 or recoil forces acting on Barrel 24, will cause the extraction and ejection of the spent Cartridge Case 16 and, possibly, the loading of a new Round 10 by Loading Mechanism 36.

It will be apparent from the above, and it is well known to those of ordinary skill in the relevant arts, that the operations of a Firearm 12 will result in pressures and forces on a Cartridge Case 16 or Bullet 14 by various components of the Firearm 12 to emboss or otherwise imprint identifying indicia on the Cartridge Case 16 or Bullet 14. For example, Firing Pin 38 will impact Primer 20 will sufficient force that an Marking Indicia 42M on Firing Pin Face 44 will imprint a corresponding inverse Identifying Indicia 42I on the Impact Face 201 of Primer 20. In addition, the pressures generated within a Cartridge Case 16 by the burning Propellant Charge 18 will cause Circumferential Wall 16W to expand against Inner Surface 46I of Chamber 28 with sufficient pressure that the corresponding inverse image of an Marking Indicia 42M on the Inner Surface 48 will be imprinted as an Identifying Indicia 42I on Circumferential Wall 16W. In a like manner, either or both of the force exerted by Bolt Face 50 on Base Face 52 of a Cartridge Case 16 in chambering a Round 10 and the pressure exerted by Base Face 52 on Bolt Face 50 by ignition of the Propellant Charge 18 will imprint a Marking Indicia 42M on Bolt Face 50 as an Identifying Indicia 42I on Base Face 52. It will also be recognized that Extractor 34 mechanisms in particular, and possibly Loading Mechanisms 36, may operate with sufficient force or pressures to imprint Identifying Indicia 42I on the surfaces of a Cartridge Case 16 with which they come into contact. It will also be noted, and is well known, that the interior surfaces of Barrel 24 will imprint various marks on the external surface of a Bullet 14.

While there are thereby a variety of surfaces in a Firearm 12 that may bear Marking Indicia 42M and imprint the corresponding inverse Identifying Indicia 42I, it will be understood that certain surfaces are preferable over others for these purposes. For example, the forces exerted by an Extractor 34 mechanism or a Loading Mechanism 36, and the areas of a Cartridge Case 16 that they operate upon, are generally insufficient for the desired Identifying Indicia 42I. In further example, and while a Firing Pin Face 44 is of sufficient dimensions and strikes with sufficient force to provide acceptable Identifying Indicia 42I, a Firing Pin 38 is readily removed and replaced, thereby breaking the correspondence between a Firearm 12 and the Identifying Indicia 42I.

According to the present invention, therefore, the preferred Firearm 12 surfaces for imprinting Identifying Indicia 42I on a Cartridge Case 16 include, for example, Inner Surface 46I of Chamber 28 and Bolt Face 50 of Bolt 30, as indicated in FIG. 2, but may include other surfaces. It will also be apparent that the material or structure comprising Marking Indicia 42M must have sufficient hardness and durability to physically stamp Marking Indicia 42M into or onto large numbers of Cartridge Cases 16 and into or onto a range of Cartridge Case 16 materials, such as brass, steel, other metals and yet other materials.

For these reasons, one or more Marking Indicia 42M may preferably formed directly in or on the materials of Inner Surface 46I of Chamber 28 or Bolt Face 50 as the materials of Chamber 28 and Bolt 30 normally possess the required hardness and durability. The Marking Indicia 42M may thereby be formed in, for example, an Inner Surface 46I of a Chamber 28, in a Bolt Fact 50 or in a Firing Pin Face 44, and may assume any desired form, such as a code, a bar code, a character set, a symbol, a design or any other identifying mark, and may be formed by a recessed indicia etched into the surface, a raised indicia formed by etching away the surrounding surface, or a combination thereof.

In other embodiments, or in addition to Marking Indicia 42M formed directly in the materials of Bolt 30 or Chamber 28, for example, Marking Indicia 42M may be implemented through Marking Inserts 54 which are attached to or preferably embedded in the material of, for example, Inner Surface 46I of Chamber 28, Bolt Face 50 or Firing Pin Face 44. Marking Inserts 54 may be comprised of any material suitable for the purpose, such as stainless steel, hardened steel, titanium, composites, ceramics, and so on, and will bear the Marking Indicia 42M on a Marking Face 54F that comes into contact with, for example, the Cartridge Case 16 or Primer 20. Again, the indicia may assume any desired form, such as a code, a bar code, a character set, a symbol, a design or any other identifying mark, and may be formed by a recessed indicia etched into the surface, a raised indicia formed by etching away the surrounding surface, or a combination thereof.

A Marking Insert 54 may be of any cross section shape suitable for mounting the Marking Insert 54 onto or into the selected Firearm 12 component or components, such as, the Inner Surface 46I of a Chamber 28, a Bolt Face 50 or a Firing Pin Face 44. A Marking Insert 54 may, for example, be cylindrical, hexagonal, pentagonal, square, triangular, round, elliptical or frusto-conical in cross section and may be mounted onto or preferably into the selected Firearm 12 surface by, for example, mechanical bonding, welding, soldering, or an interference fit, or may be threaded into the Firearm 12 component. The Marking Face 54F will generally be shaped to conform to the surface in which the Marking Insert 54 is embedded, such as a flat Bolt Face 50 or a cylindrical Inner Surface 46I of a Chamber 38 or a domed Firing Pin Face 44.

It will be recognized that a plurality of Marking Indicia 42M may be implemented in a given Firearm 12 and may be formed upon or embedded in any Firearm 12 surface that is brought into contact with any element or part of a Cartridge Case 16. In presently preferred embodiments, there are a plurality of Marking Indicia 42M located on or embedded in a plurality of components or surfaces of a Firearm 12 to increase the probability that there will be at least one sufficiently clear Identification Indicia 42I on any given fired Cartridge Case 16. In addition, the locations of the Marking Indicia 42I are preferably selected so that they cannot be readily removed by a simple replacement of a part, such as a firing pin, cannot be easily removed or mutilated by other means, and, preferably, cannot be readily located. Also, in the preferred embodiments of Identification Indicia 42I, the Identifying Indicia 42I should uniquely identify each Firearm 12, and if possible each major component of a Firearm 12, such as a Barrel 24, Bolt 30 or Chamber 30, by including such information as a unique identifying number or code, the type, model, manufacturer, and date of manufacture of the firearm or component, and so on.

Briefly considering the generation of Marking Indicia 42M on a surface of, for example, a Marking Insert 54, or a surface of, for example, an Inner Surface 46I of a Chamber 28, a Bolt Face 50 or a Firing Pin Face 44, it will be recognized by those of ordinary skill in the relevant arts that such Marking Indicia 42M are readily and preferably formed by laser micro-machining processes.

C. Exemplary Laser Imaging System For Micro-Machining Marking Indicia

Figure 3:
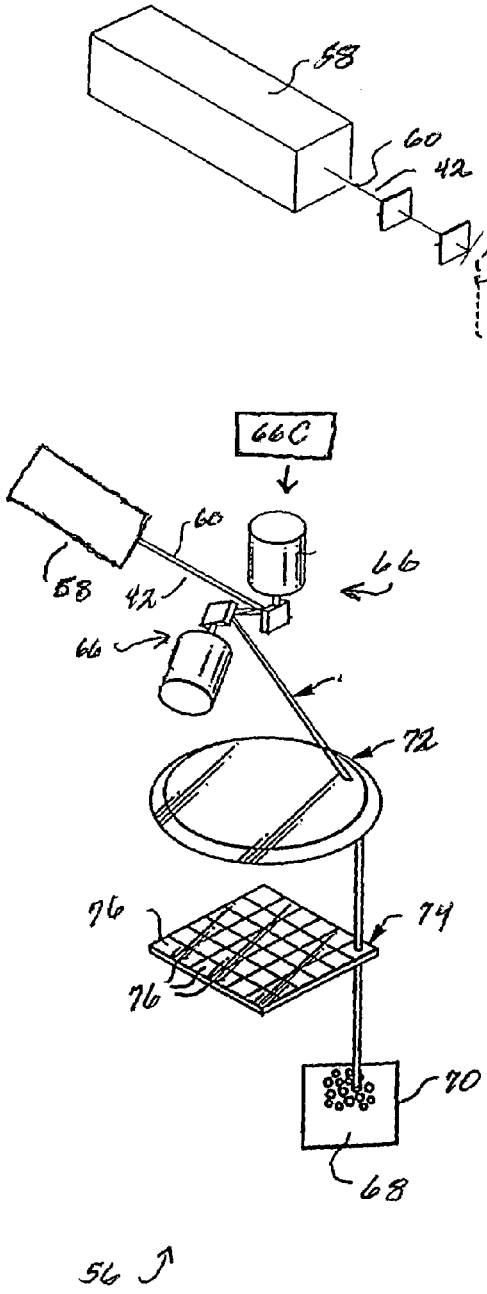
FIGS. 3 and 4 are diagrammatic representations of laser systems for creating indicia.

An exemplary and typical laser micro-machining system suitable for generating Marking Indicia 42M is a selected surface is illustrated in FIG. 3. As shown therein, an Image Imprinting System 56 for ablating high-density array of vias or indentations in a surface of an object to form Marking Indicia 42M therein or thereon includes a Laser 58 for generating and outputting a Laser Beam 60. Laser Beam 60 may be, for example, an ultraviolet, a visible, an infrared, a coherent radiation beam or some other type of light radiation beam and is directed along a Laser Axis 62 toward one or more Expansion Lenses 64, which expand the diameter of the generated ultraviolet, visible, infrared or other light radiation Laser Beam 60 to a desired diameter.

The expanded Laser Beam 60 continues along Laser Axis 62 and is directed through Steering Mirrors 66, which are controlled by a Computer 66C to control the direction and location of the beam with respect to Machining Surface 68 of a Workpiece 70. Laser Beam 60 then passes through Collimating Lens 72 and to Holographic Imaging Lense 74.

Holographic Imaging Lens 74 includes a plurality of Holographic Imaging Segments 76 which focus the laser beam at a desired location or locations along Machining Surface 68 of Workpiece 70 for the purpose of drilling, burning or otherwise forming desired blind vias, apertures, openings, indicia, indentations or other surface contours therein of desired size and depth by etching, or otherwise removing, the material of Machining Surface 68. The size and shape of the area from which the material is removed is defined or determined by the design characteristics of a corresponding Holographic Imaging Segment 76, while the volume or depth of material removed is controlled by the power levels or number of the laser beam pulses directed at a given area.

It will be understood by those of ordinary skill in the relevant arts that the number of Holographic Imaging Segments 76 used in a given machining operation may be variable and that, for example, a given Marking Indicia 52M etched into a surface may be comprised of the combination or compilation, in parallel or in sequence, of multiple Holographic Imaging Segments 76. The system or an equivalent system thereby allows very complex Marking Indicia 76 to be formed, and allows different elements of a Marking Indicia 42I to be formed of different Holographic Imaging Segments 76. For example, one Holographic Imaging Segment 76 may represent a firearm manufacturer, another the firearm type or model, and so on, and certain Holographic Imaging Segments 76 may be changed or varied from one Marking Indicia 42M to the next, as when assigning unique serial numbers.

Figure 4:
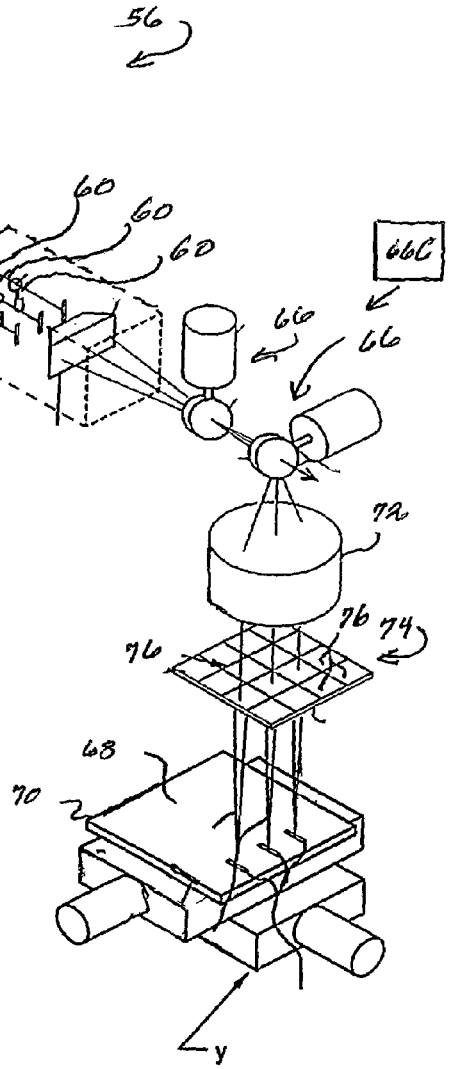

FIG. 4 illustrates a further embodiment of a Image Imprinting System 56 wherein a Splitter 78 is employed to split Laser Beam 60 into multiple Laser Beams 60 and Image Imprinting System 56 includes multiple sets of Steering Mirrors 66 to direct the multiple Laser Beams 60 through a Holographic Imaging Lens 74 and to a Machining Surface 68 of Workpiece 70, thereby permitting the concurrent generation of multiple Marking Indicia 42I, or the concurrent etching of multiple elements of a Marking Indicia 42I.

It will be understood by those of skill in the relevant arts that an Image Imprinting System 56 may employ any of a range of types of Lasers 58, including ultraviolet, visible light and infra-red lasers. Suitable lasers may include, for example, slow flow CO2, CO2 TEA (transverse-electric-discharge), Impact CO2, and Nd:YAG, Nd:YLF, and Nd:YAP and Nd:YVO and Alexandrite lasers, gas discharge lasers, solid state flash lamp pumped lasers, solid state diode pumped lasers, ion gas lasers, and RF wave-guided lasers. The specific type of laser will depend upon the specific types of materials and specific types of laser machining operations to be performed. For example, in operations with longer wavelength lasers, such as $CO_2$ and Md:YAG infrared lasers, the interaction between the laser and the material is a thermal process which produces charring, or glassification in ceramics, and leaves a relatively poor surface quality with some materials. The processes at ultraviolet wavelengths as generated by, for example, excimer lasers, is however, and for many materials of interest, a "cold process" which uses energy to break chemical bonds in the material rather than to generate heat in the material. Thus, Identification Indicia 42I having excellent accuracy and quality can be easily produced in a desired surface without substantially altering the characteristics of the material or creating chars and/or clumps of material.

Lastly in this regard, it must be noted that laser machining processes are particularly adaptable to the etching of Marking Indicia 42M in confined spaces, such as on an Inner Surface 46I of a Chamber 28. In such instances, the optic path or paths of an Image Imprinting System 56 may be extended by an additional Steering Mirror 66 optical path inserted into the Chamber 28 of a Barrel 24 such that the laser beam or beams are directed axially into the Chamber 28 and redirected to a Machining Surface 68 located on the Inner Surface 46I. The extended optical may be implemented using, for example, Micro-Electro-Mechanical (MEM) mirrors, which are significantly smaller than conventional galvanometer controlled mirrors.

Finally, and as will be described further in the following, it will be recognized that a Image imprinting System 56 may be used to print, imprint, emboss, etch, ablate, engrave or otherwise form an image or images on a surface by etching or otherwise removing selected portions of the surface or by selective removal of a material on the surface, such as various forms of ink or deposited coatings. It will also be understood that the image or images may assume many forms, as determined by Holographic Imaging Segments 76 or similar means. Examples of such images may include a code, a bar code, a character set, a symbol, a design, an alphanumeric set or some other identifying mark or, as described in further detail in the following, an encoded hologram or a encoded concentric circular barcode. In this regard, and as will be discussed further in the following, the imprinting, etching or micro-machining of a holographic image such as an encoded hologram or a encoded concentric circular barcode variable may incorporate such encoding variables as the wavelength of light used in forming the image, and subsequently in reading the image, or the working distance of the holographic image, which is a factor in both forming and reading the image.

D. Methods For Reading Of Identification Indicia

Figure 6:
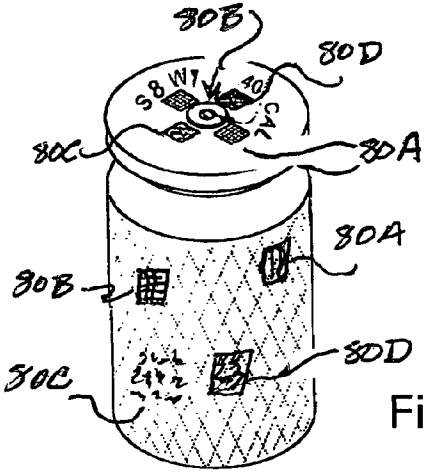
FIGS. 5 and 6 are illustrations of indicia on a cartridge case.
Figure 5:
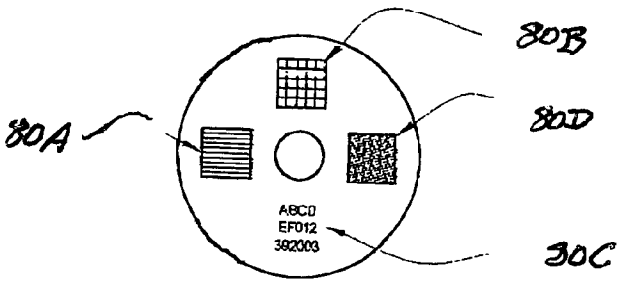

As described, the identification of the Firearm 12 which microstamped an Identification Indicia 42I into or onto a Cartridge Case 16 is dependent upon the clarity with which the Identification Indicia 438 may be read. As also described, an Identification Indicia 42I may include, for example, a code, a bar code, a character set, a symbol, a design, an alphanumeric set or some other identifying mark or, as described in further detail in the following, an encoded hologram. As also discussed, an Identifying Indicia 42I may be formed by recessed or raised areas of the material the Identification Indicia 42I is stamped into or onto, or of both raised and recessed areas together forming the Identification Indicia 42I. Examples of Identification Indicia 42I embossed or printed on various surface of a Cartridge Case 16 are illustrated in FIGS. 5 and 6 and include a Raised Bar Code 80A, a 2D (two dimensional) Bar Code 80B, a Raised Alphanumeric Code 80C and a raised Encoded Hologram Code 80D. In this regard, is should be noted that an Encoded Hologram Code 80D may be formed from, for example, alphanumeric data identifying, for example, a firearm maker, a firearm model and a unique identifier for the Firearm 12 or at least the Bolt 30, Firing Pin 44 or Barrel 24. This data may then be transformed or encoded into a hologram, and the reverse transform or image of the hologram etched, machined or otherwise formed in, for example, Bolt Face 50. As is understood by those of ordinary skill in the relevant arts, any part or portion of a hologram essentially contains information describing or comprising the entire hologram, so that the entire hologram and the information encoded therein may be reconstructed from any part or portion of the hologram. For this reason, it is very difficult to destroy, eradicate or obscure Identification Indicia 42I in the form of a Encoded Hologram Code 80D.

It will also be recognized that certain parts of a firearm, and in particular those surfaces that are machined, will typically have a characteristic surface "pattern" that is unique to a given manufacturer or even a given model of firearm and that such a pattern will be embossed, stamped or otherwise formed on a surface of a Cartridge Case 16. While normally considered as a form of "scratch and ding" or "ballistic finger print" identifier, such patterns, as will be discussed in the following, may be intentionally formed as Identification Indicia 42I, either alone or in combination with other Identification Indicia 42I.

It will be recognized, however, that an Identification Indicia 42I is physically and visually small and may be imperfectly formed or may be obscured or deformed to at least some degree. For example, the degree of vertical relief in the Identification Indicia 42I, that is, the degree to which the surface of the material forming the Cartridge Case 16 or a Impact Face 201 of Primer 20 is raised or lowered with respect to the surrounding surface when the Identification Indicia 42I is formed, and thus the contrast and clarity of the Identification Indicia 42I, may vary widely. For example, the degree of relief and clarity of an Identification Indicia 42I may be dependent upon such factors as the hardness or "stiffness" of the material and the force exerted in marking the material, which may in turn depend upon such factors as the striking force of the firing pin, the pressure exerted on the wall of a Cartridge Case 16 by the Propellant Charge 18, or the pressure exerted by the Bolt Face 50.

Other factors in forming and reading an Identification Indicia 42I may include, for example, dirt, tarnish, corrosion or grease on the surface in which the Identification Indicia 42I is formed, attempts to eradicate an Identification Indicia 42I, wear of the firearm, or distortion in forming the Identification Indicia 42I. Distortion in an Identification Indicia 42I, for example, may arise from many causes, such as movement, "setback" or rupture of primer 410, overexpansion or longitudinal movement of Cartridge Case 16 due, for example, to a worn or overlarge Chamber 28 or a mismatch between the Firearm 12 and Round 10 of ammunition, and so on. These and other factors may also operate to obscure or distort an Identification Indicia 42I after it is formed into a Cartridge Case 16, such as during a period after the Round 10 is fired and before the Cartridge Case 16 is found and taken as evidence. Such factors may include, for example, physical damage to the Cartridge Case 16 or tarnish or corrosion of the surface 452.

The reliable and accurate "reading" of an Identification Indicia 42I and thus the identification of a firearm that formed an Identification Indicia 42I on a Cartridge Case 16 is thereby dependent upon an ability and capability to "read" and capture an Identification Indicia 42I image from a surface of a Cartridge Case 16, that is, the clarity with which the Identification Indicia 42I can be read and identified.

FIGS. 7A and 7B illustrate an exemplary Indicia Imaging Apparatus 82 for capturing one or more Identification Indicia 42I image from one or more surfaces of a Cartridge Case 16, such as a base surface or wall surface of the Cartridge Case 16 or the face of the primer. The Indicia Imaging Apparatus 82 includes an Optical Magnifying Mechanism 84 for viewing an Indicia Surface 86 bearing an Identification Indicia 42I along a Viewing Axis 88 that is generally perpendicular to the Cartridge Case Surface 86 bearing the Identification Indicia 42I. In this regard, it will be recognized that the method and apparatus of the present invention is equally usable for identifying an Identification Indicia 42I stamped or otherwise formed in other elements of a Round 10, such as the Bullet 14.

Indicia Imaging Apparatus 82 further includes a Specimen Mounting Device 90 for holding an item to be viewed, such as a Cartridge Case 16 or a Bullet 14, with the Indicia Surface 86 bearing the Identification Indicia 42I or a region of an Indicia Surface 86 suspected of bearing an Identification Indicia 42I, such that the Indicia Surface 86 is parallel to a plane perpendicular to the Viewing Axis 88, wherein the Viewing Axis 88 extends along the perpendicular or z-axis and the plane of the Indicia Surface 86 extends along the plane defined by the horizontal x- and y- axes. The Indicia Imaging Apparatus 82 may further include a Positioning Mechanism 92 whereby the Specimen Mounting Device 90 may be positioned along the z-axis, that is, the Viewing Axis 88, for focusing purposes. Focusing may also or alternatively be accomplished in the Optical Magnifying Mechanism 84, or by a combination thereof. Positioning Mechanism 92 will typically include mechanisms for positioning the Specimen Mounting Device 90 in the x- and y- planes so that an Identification Indicia 42I or region of a Indicia Surface 86 suspected of bearing an Identification Indicia 42I may be generally centered along the Viewing Axis 88, and so that the Indicia Surface 86 may be moved or scanned in the x- and y- planes with respect to the Viewing Axis 88.

Figure 7:
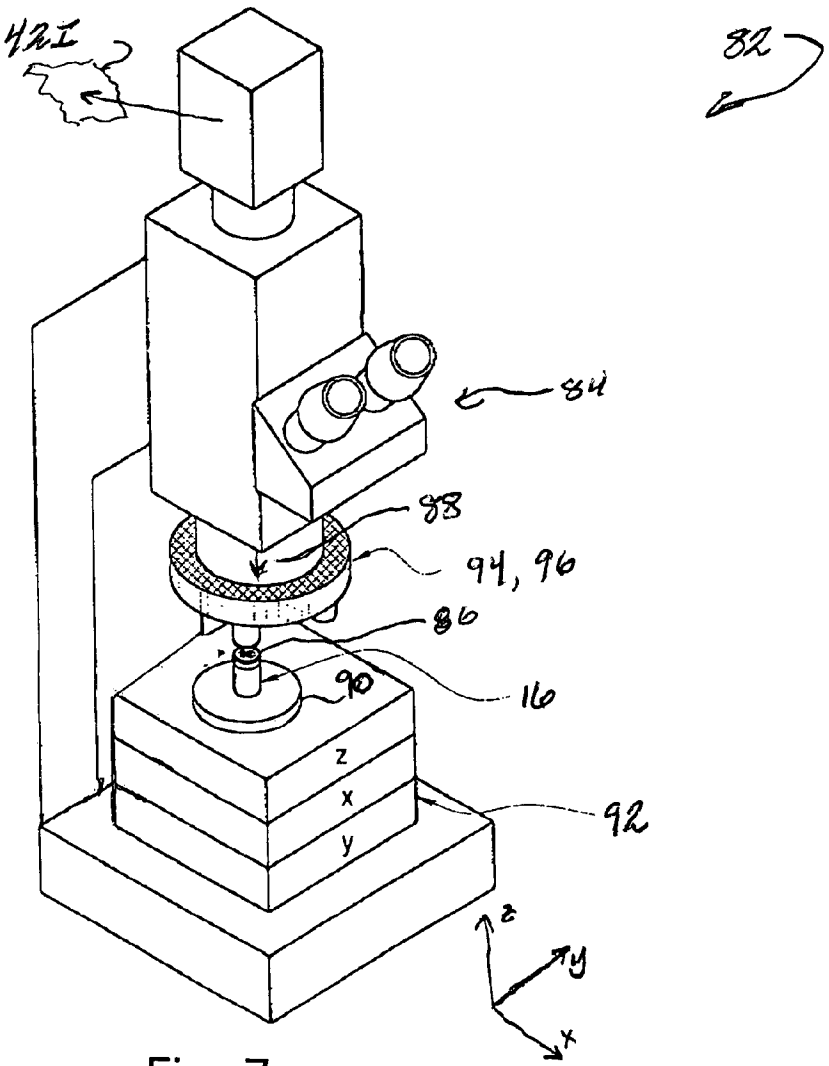
FIGS. 7, 8 and 9 and diagrammatic representations of an indicia imaging device and an indicia imaging and recognition system.

A Specimen Mounting Device 90 is illustrated in FIG. 7 as supporting and holding a Cartridge Case 16 in a position so that an Indicia Surface 86, such as the wall or base of a cartridge case may be viewed by Optical Magnifying Mechanism 84. It will be recognized and understood, however, that a Specimen Mounting Device 90 may be readily designed and adapted to hold a cylindrical item, such as a Cartridge Case 16 or Bullet 14, in the vertical or horizontal positions so that the wall or base surfaces of a cartridge may be viewed by Optical Magnifying Mechanism 84. In this regard, it will be further recognized and understood that a Specimen Mounting Device 90 may be designed and constructed to allow rotation of the Cartridge Case 16, Bullet 14 or other item about any or all of the x-, y- and z- axes, thereby allowing all exterior surfaces of the item to be viewed and allowing the item to be oriented around any selected axis. The design of Specimen Mounting Devices 90 capable of lateral motion in any plane or along any axis and capable of rotation about any axis are well known to those of skill in the arts, and therefore will not be discussed in further detail herein.

As indicated in FIG. 7, an Indicia Imaging Apparatus 82 of the present invention also includes an Illuminator 94 directing illumination onto the Indicia Surface 86 being viewed by Optical Magnifying Mechanism 84. According to the present invention, Illuminator 94 directs illumination onto the Indicia Surface 86 being viewed along an Illumination Plane 96, or axis, that is aligned substantially normal to the Viewing Axis 88, thereby approximately parallel to the x/y plane. The Illumination Plane 96 is thereby approximately parallel to and is incident upon the Indicia Surface 86 being viewed along Viewing Axis 88, at least in a region wherein the Identification Indicia 42I being examined is located or where an Identification Indicia 42I is suspected of being present. As will be described below, the angle of Illumination Plane 96 is variable and adjustable with respect to the surface being examined, as is the intensity of Illuminator 94, so that Illuminator 94 can provide the optimum level and angle of lighting to the surface being viewed. Illuminator 94 thereby illuminates the Identification Indicia 42I, or region suspected of containing an Identification Indicia 42I in a manner to maximize the contrast and resolution of the highlighted and shadowed areas of the Identification Indicia 42I or region suspected of containing an Identification Indicia 42I, that is, the higher and lower areas of the region, to thereby provide the maximum image contrast and clarity.

In a presently preferred embodiment of an Indicia Imaging Apparatus 82, Illuminator 94 and Optical Magnification Mechanism 84 include or are comprised of an optimized holographic imaging system integrated into a mono-chromatic and multi-chromatic illuminator to provide illumination from various angles onto the working areas of the Optical Magnifying Mechanism 84 and Indicia Surface 86 and to provide a non-shadowing intensity variable light.

An Illuminator 94 may further include facilities for providing colored or polarized light, while the Optical Magnifying Mechanism 84 may include appropriate filters, and various lenses, masks and so on to shape Illumination Plane 96 as desired or necessary. Also, it will be understood that imaging systems of the present invention may utilize illumination other than visible light, such as ultraviolet or infrared radiation, and may incorporate the appropriate filters, lenses and imaging apparatus as necessary and may incorporate a wide range of illumination sources, such as a laser diode array and/or light emitting diode array. The illumination mechanism may also include various positioning and rotational mechanisms to control the angle of incidence of Illumination Plane 96 with the surface being viewed and, in at least some embodiments, the angle of rotation of the Illumination Plane 96 axis around Viewing Axis 88.

Figure 8:
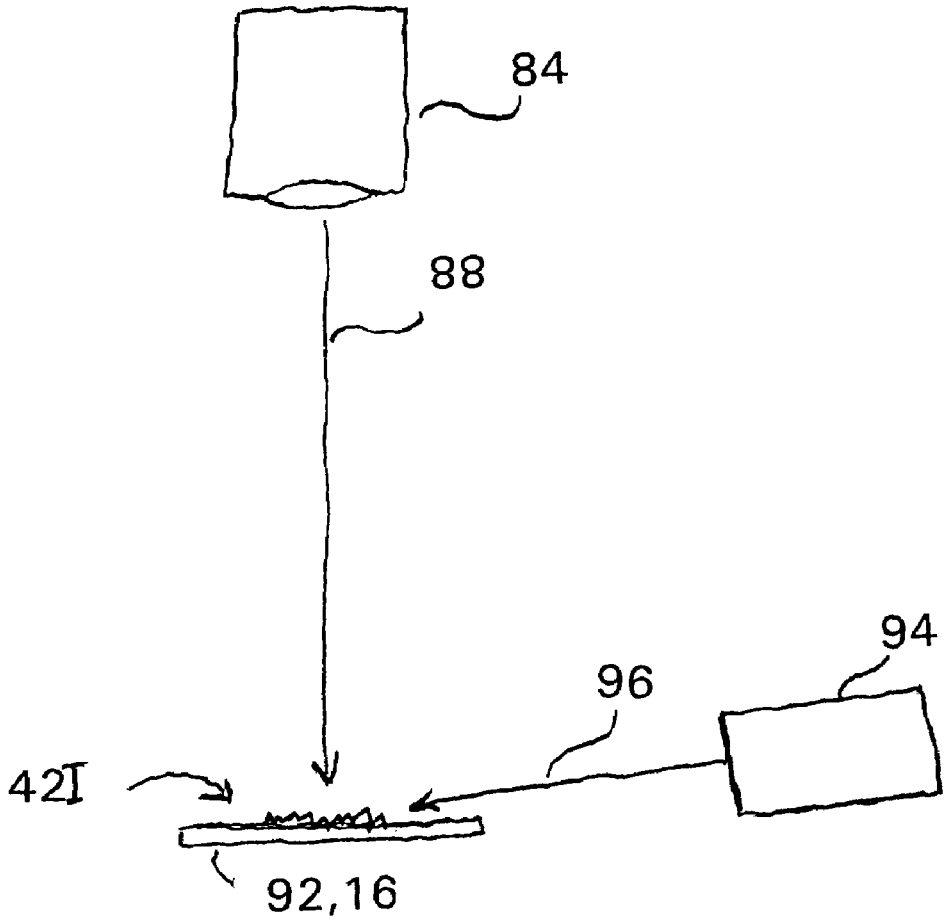

As illustrated in FIG. 8, an Indicia Imaging Apparatus 82 will typically further include an Image Capture Device 98, such as a CCD(Charge Coupled Device) camera, for capturing and providing digital Surface Images 100 of a selected area of a Indicia Surface 86, including any Identification Indicia 42I appearing therein. In this regard, it will be recognized and understood that Optical Magnifying Mechanism 84 will be capable of providing optical images at a range of selectable magnifications, resolutions and image areas. Image Capture Device 98 captures digitally encoded images from the optical images provided by Optical Magnifying Mechanism 84, and can thereby capture digitally encoded images of a range of selectable magnifications, resolutions and image areas.

Lastly in this regard, the Indicia Imaging Apparatus 82 will typically include a Frame Grabber 102 or equivalent for capturing Surface Images 100, and a Motion Card 104, controlled by a user or by other elements of the apparatus, for controlling viewing Specimen Mounting Device 90. Motion Card 104 may, for example, include an automatic focusing mechanism whereby a present Surface Image 100 is analyzed to determine the sharpens and focus of the image, and the analysis results employed, through Motion Card 104, to control the focus of the optical elements of Optical Magnifying Mechanism 84. Such autofocus methods and mechanisms are, however, well known in the art and need not be discussed further herein.

As shown, the Surface Images 100 may be communicated to an Image Processing System 106 through a Data Link 108 comprised, for example, of a network, computer, database or server, or other system. Then Image Processing System 106 may be comprised, for example, of an Image Processing and Analysis System 110 for performing such operations as image enhancement, image analysis and recognition, and so on, and an Image Data Storage System 112 for storing the Surface Images 100, including any Identification Indicia 42I found thereon. Image Data Storage System 112 may also store, for example, information translating and identifying various assigned Identification lndicia 421, and may include mechanisms for identifying firearms from the imaged Identification Indicia 42I.

For example, the Image Processing System 106 may include a specialized computer algorithm for generating one or more of a reconstruction, a decipherment or an optical recognition at least one of a make, a model, a serial number, a unique ballistic identifier or a ballistic identifier tag of a specific firearm used to fire the cartridge or bullet being analyzed by viewing one or more indicia on a surface of the cartridge or bullet, wherein the indicia may be comprised of an encrypted code, an encoded hologram, encoded alphanumeric code, a barcode or any other form of indicia on a surface of the cartridge or a bullet, and to analyze the captured image.

In summary, therefore, the present invention provides an apparatus and method for identifying firearms that includes the steps of:

(A) illuminating a base of the fired cartridge from a firearm found at a crime scene using axially homogenized light from various illumination angles using a holographic imaging system integrated into either a mono-chromatic or multi-chromatic light;

(B) obtaining, through an imaging microscope, an image of the encoded hologram or encoded alphanumeric code or barcodes or indicia that form the breech face impressions on a primer of the cartridge or bullet; and, (C) utilizing specialized analysis software to read the encoded codes and provide the serial number or tracking number unique to the firearm that fired the bullet or cartridge.

The method of the present invention thereby does not require a comparison of cartridges, but simply takes an image of the code embossed on the cartridge or bullet that is formed upon the firing of the firearm and the subsequent ejection of the cartridge or bullet from that specific firearm.

E. Creation and Reading of Encoded Multi-Dimensional Indicia

It has been described herein above that a wide range of types and forms of Identification Indicia 42I and corresponding Marking Indicia 42M may be used for the purpose of identifying a firearm that has fired a round by embossing or imprinting an Identification Indicia 42I unique to the firearm on the cartridge case, or bullet, of the round. It is preferable that the Identification Indicia 42I be physically small, and that the indicia convey a large amount of information, such as a unique firearm identifier, a manufacturer, a model or type identifier, and so on.

One of the presently most commonly proposed and useful forms of Identification Indicia 42I is the barcode, which, until the present invention, offered the capability of representing a significant amount of information in a relatively small space. The most common form of barcode is a bar, that is, a series or sequence, of optically or magnetically readable parallel stripes of different widths etched, printed or imprinted on an object wherein the widths and locations of the stripes convey the information contained therein. Two dimensional barcodes have also be developed, wherein the information is represented by an array or dots or rectangles that are read by scanning in two dimensions, or directions. Two dimensional barcodes contain significantly more information than do one dimensions barcodes, but are more difficult to form and print and are more susceptible to reading errors and information loss due to damage.

Barcodes suffer from a number of limitations and problems which limit their suitability as Identification Indicia 42I, however. For example, most barcodes are normally monochromatic, which limits information representation to the physical dimensions of the bars, dots and rectangles and the uses of barcodes to applications suitable for simple laser, magnetic or optical scanning methods. The limitation to simple scanning methods also restricts the security of the information represented therein. That is, barcodes are readily readable by simple, commonly available scanning devices and the possible encoding of the information stored in a barcode is limited by the relatively small amount of data that can be stored in a barcode.

Recent developments in conventional barcodes have attempted to overcome information storage and security limitations by various additional encoding factors. For example, some methods overprint a one dimensional barcode with a second barcode of a different color, use transparent ink containing infrared absorbers to introduce an additional variable, print different types of barcodes over one another, and use materials having various infrared or ultraviolet properties with colored barcodes to introduce additional variables. While such methods increase the amount of information that can be represented in a barcode by adding additional variables to the barcode representation, in a manner analogous to adding bits to a binary number representation, issues regarding security of data, reading errors and data loss through damage remain a serious problem. For example, it is significantly more difficult to read a multi-color barcode or a barcode using infrared or ultraviolet properties or multiple coding patterns than a monochrome barcode, and such barcodes are much more susceptible to damage, such as wear and fading, than are monochrome barcodes.

According to the present invention, however, the above problems are addressed by Identification Indicia 42I in the form of Encoded Hologram Multi-Dimensional Barcodes (EHMDBs), which, according to the present invention, add additional dimensions to the information representation capacity of an Identification Indicia 42I and, in particular, will introduce a spectral dimension to Identification Indicia 42I and 42M. As will be discussed below, Encoded Hologram Multi-Dimensional Barcodes (EHMDBs) may be implemented as either or both of Encoded Holograms (EHs) or Encoded concentric Circular Barcodes (ECCBs).

According to the present invention, the designs of Encoded Hologram Multi-Dimensional Barcodes (EHMDBs), whether embodied as Encoded Holograms (EHs) or as Encoded concentric Circular Barcodes (ECCBs), are based on several variables which affect the geometric construction, or pattern of markings, of the Encoded Hologram Multi-Dimensional Barcodes (EHMDBs). One variable is the wavelength of light or radiation used as the encoding variable, and another is the working distance of the Encoded Hologram Multi-Dimensional Barcodes (EHMDBs). The added spectral component is thereby obtained through spectral factors that effect the geometries of the Encoded Hologram Multi-Dimensional Barcodes (EHMDBs), that is, the EHs or ECCBs, themselves. In particular, and according to the present invention, sets of wavelengths are used for specific encoding applications wherein each wavelength or set of wavelengths has a particular unique effect on the final outcome of the geometric dimensions of the Encoded Hologram Multi-Dimensional Barcodes (EHMDBs), that is, the EHs and ECCBs, and their security levels. One consequence of this method for generating Encoded Hologram Multi-Dimensional Barcodes (EHMDBs) in the form of EHs and ECCBs is that numerous distinct encoded Encoded Hologram Multi-Dimensional Barcodes (EHMDBs) may be created as EHs or ECCBs, thus providing more extensive multi-dimensional encoding than previously possible.

Figure 10A:
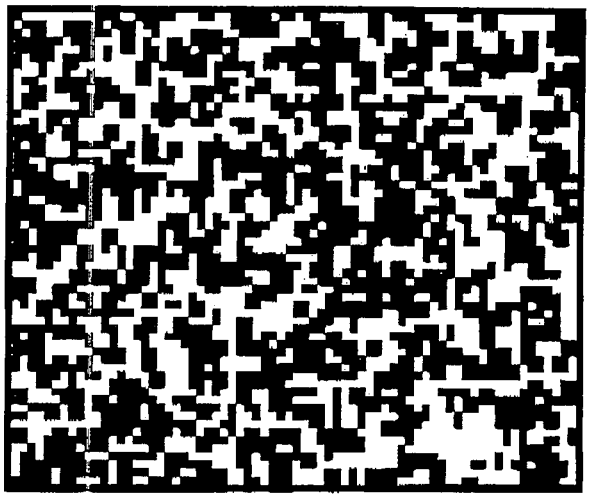
FIGS. 10A, 10B and 10C are representations of encoded hologram indicia.
Figure 10B:
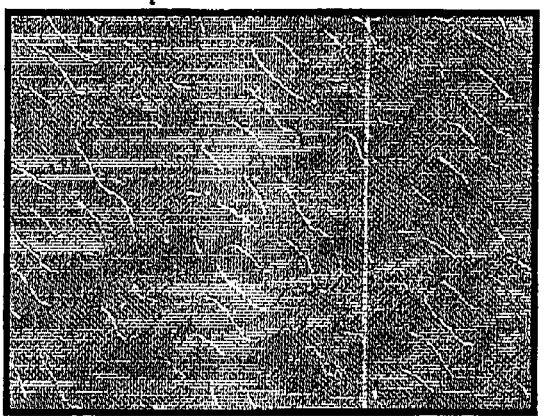
Figure 10C:
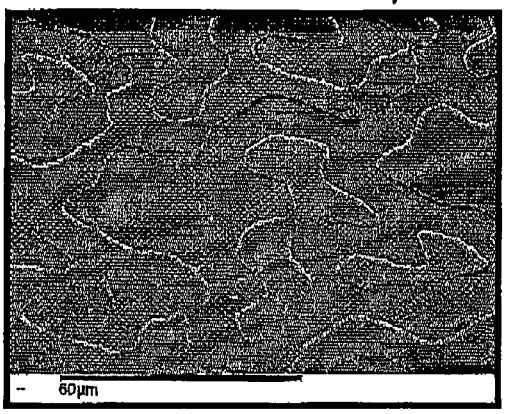
Figure 11A:
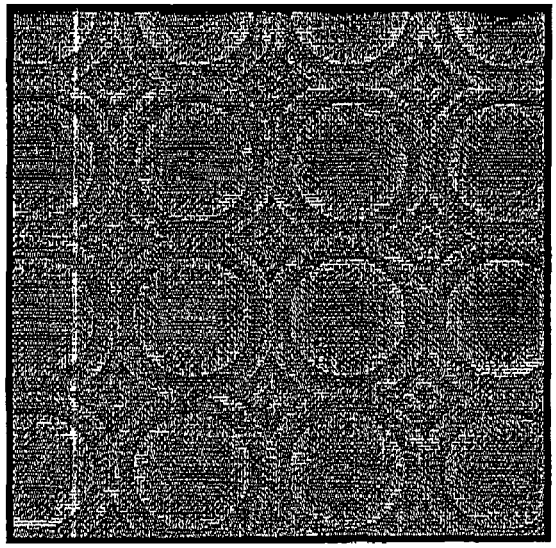
FIGS. 11A, 11B and 11C are representations of aspects of an encoded concentric circular barcode.
Figure 11B:
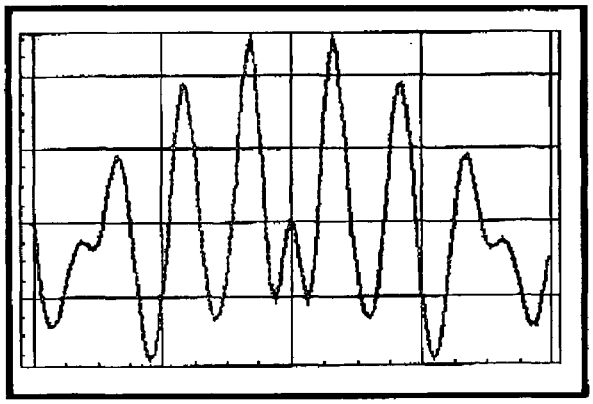
Figure 11C:
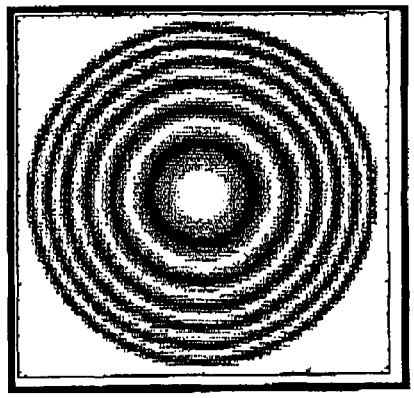

Referring to FIGS. 10A through 10C and 11A through 11C, therein are respectively illustrated diagrammatic representations of Encoded Multi-Dimensional Indicia (EMDI) 114 according to the present invention, wherein FIGS. 10A through 10C illustrate Encoded Holograms (EHs) 114EH and FIGS. 11A through 11C illustrate various aspects of Encoded Concentric Circular Barcodes (ECCBs) 114EC.

In this regard, FIG. 10A illustrates an Encoded Hologram (EH) 114EH wherein the hologram image is comprised of square pixels and FIGS. 10B and 10C illustrate Encoded Holograms (EHs) 114EH in the form of etched encoded holograms.

FIG. 11A, in turn, illustrates an etched encoded concentric circular barcode array and it may be seen that the encoding of information in a concentric circular barcode results in a simpler design than does the hologram encoded design illustrated in FIGS. 10A–10C, and uses a circular based intensity encoding method wherein each concentric ring pattern corresponds to one or more specific alphanumeric digits or letters. The array of such concentric ring patterns illustrated in FIG. 11A is, for example, a series of alphanumeric codes arranged to allow an very large amount of data to be stored in the array, and to allow the data to be decoded with a reader or decoder specifically adapted to this encoding method. It should be noted that in the example illustrated in FIG. 11A each concentric ring pattern of the array of concentric ring patterns represents a corresponding alphanumeric character or digit. In other embodiments, however, and depending upon the complexity of the concentric ring patterns, including the number of rings in each pattern, a plurality of alphanumeric characters or digits or combinations thereof may be encoded in each ring pattern of the array. This encoding is further illustrated in FIGS. 11B and 11B, which respectively illustrates the depth profile encoding method across a portion of a concentric circular barcode and a top view surface analysis of such a barcode.

EHMDBs 114 may be encoded by a variety of methods, examples of which may include but not be limited to binary phase Fourier DOE, CGH, Lohmann, Lee, Fourier, Fraunhofer, Fresnel or kinoform types of hologram encoding algorithms, including multi-phase levels fro level 2 and greater phase levels. The encoding algorithms may include error checking functions to reduce reading errors, which may occur when the Identification Indicia 42I or other marks have faded or become worn or damaged and no longer imprint or emboss a clear, high quality Identification Indicia 42I. It will also be recognized that the encoded holograms and Encoded concentric Circular Barcodes may use any standard encoding algorithm as used, for example, for encoding diffractive and holographic images.

As described, and according to the present invention, Encoded Multi-Dimensional Indicia (EMDI) 114, such as Encoded Holograms 114EH or Encoded concentric Circular Barcodes (ECCBs) 114EC, may be employed as Marking Indicia 42M to imprint, emboss or otherwise form corresponding inverted Identification Indicia 42I on such surfaces as cartridge cases or bullets. Multi-Dimensional Barcodes (EHMDBs) 114 may be formed, for example, directly into the material of a firearm, such as the inner surface of a chamber, the face of the bolt or firing pin, the extractor mechanism, or a surface of a barrel ramp, that is, a portion of the barrel and breach formed to guide a round from a clip and into the breach. Multi-Dimensional Barcodes (EHMDBs) 114 may also be formed into the face of a Marking Insert 54, which may in turn be embedded in such surfaces of a firearm.

It must also be recognized, however, that the Marking Indicia 42M and Identification Indicia 42I of the present invention, that is, Encoded Holograms (Ehs) 114 and Encoded concentric Circular Barcodes (ECCBs) 114, may be used in many other applications requiring Identification Indicia 42I, and may be formed on variety of surfaces by a wide range of methods. For example, and as described, Encoded Multi-Dimensional Indicia (EMDI) 114 such as Encoded Holograms 114EH or Encoded concentric Circular Barcodes (ECCBs) 114EC may be directly etched, imprinted, micro-machined into a surface by, for example, an Image Imprinting System 56, or similarly formed in a surface that is in turn used to print, imprint or emboss the image in yet another surface by, for example, impact or pressure, or by printing by a transferrable media such as ink or other forms of transferrable media or coatings.

Methods for forming Encoded Multi-Dimensional Indicia (EMDI) 114 may thereby include, for example, laser imaging, etching and engraving methods, dry etch and erosion processes such as chemical milling, ion milling and electro-discharge machining. Other methods may include, for example, ink-jet printing or letterpress, gravure, lithographic or screen printing techniques.

In other embodiments, Encoded Multi-Dimensional Indicia (EMDI) 114 may also be formed by removal of areas of a coating from a surface, such as an ink, paint or deposited or plated coating, by etching, ablating, micro-machining of the surface. Other methods involve coating or plating a surface layer of a first material onto the surface, such as an ink having a first property or color, and printing or otherwise placing an image or a reversed, negative image of the Encoded Multi-Dimensional Indicia (EMDI) 114 onto or over that initial surface in a second material having one or more properties that may be distinguished from those of the first material.

In further embodiments, Encoded Multi-Dimensional Indicia (EMDI) 114 may be formed of or in, for example, infrared, ultraviolet or visible inks or in materials having photosensitive or magneto-optic qualities, or analogous properties, so that the Encoded Multi-Dimensional Indicia (EMDI) 114 is readable only when effected, for example, by suitable radiation or illumination or under the effect of a magnetic field. In other embodiments, and for example, the pattern of magnetic ink may be read directly by a magnetic sensing scanner, while ultraviolet and infrared inks may be similarly read by suitable direct sensing scanners. Other methods for forming Encoded Multi-Dimensional Indicia (EMDI) 114 may include various chemical or mechanical treatments of a surface to provide a surface that may then be suitably modified in representation of the Encoded Multi-Dimensional Indicia (EMDI) 114.

Lastly with respect to the encoding and creation of Encoded Multi-Dimensional Indicia (EMDI) 114, the above methods for creation of a Encoded Multi-Dimensional Indicia (EMDI) 114, whether as Encoded Holograms 114EH or as Encoded Concentric Circular Barcodes (ECCBs) 114EC, may be combined in such a manner as to introduce a "third dimension" into the encoding. That is, Encoded Multi-Dimensional Indicia (EMDI) 114 may be created as superimposed layers of distinguishable elements, that is, one on top of another, and subsequently read by selective viewing or illumination of the layers, so long as the materials or methods by which the successive Encoded Multi-Dimensional Indicia (EMDI) 114 are distinguishable. Examples of such distinguishable layers may include, for example, successive overlaid Encoded Multi-Dimensional Indicia (EMDI) 114 comprised of differently colored transparent inks and various illumination sensitive inks, such as infrared or ultraviolet sensitive inks, and so on. In other instances, a first Encoded Multi-Dimensional Indicia (EMDI) 114 may be physically embossed or imprinted in the base material, and overlaid with other Encoded Multi-Dimensional Indicia (EMDI) 114 comprised of various coatings that can be distinguished from one another and through which the embossed or imprinted Encoded Multi-Dimensional Indicia (EMDI) 114 can be read. It will be recognized that, as a consequence, the user of multiple, superimposed Encoded Multi-Dimensional Indicia (EMDI) 114 will result in multiple, separately distinguishable and readable Encoded Multi-Dimensional Indicia (EMDI) 114 or in a single Encoded Multi-Dimensional Indicia (EMDI) 114 having additional "dimensions" for the representation of information, thereby significantly increasing the information capacity of the Encoded Multi-Dimensional Indicia (EMDI) 114.

It will be apparent, therefore, that the Encoded Multi-Dimensional Indicia (EMDI) 114 of the present invention, such as Encoded Holograms 114EH or Encoded Concentric Circular Barcodes (ECCBs) 114EC, may be embodied or implemented for a range of applications, and that the specific form of implementation will depend upon the specific application in which the Encoded Multi-Dimensional Indicia (EMDI) 114 are used. For example, the Encoded Multi-Dimensional Indicia (EMDI) 114 such as Encoded Holograms 114EH or Encoded concentric Circular Barcodes (ECCBs) 114EC may be implemented as Marking Indicia 42M to be imprinted or embossed onto cartridge cases or bullets as Identification Indicia 42I for the purpose of identifying firearms that had discharged a cartridge case or bullet.

In other applications, such as product identifiers, anti-counterfeit markings, security badges or codes, and so on, the methods and materials used to create the Encoded Multi-Dimensional Indicia (EMDI) 114, and the methods for reading such Encoded Multi-Dimensional Indicia (EMDI) 114 will depend upon the application and materials involved. It must be noted, however, that certain methods may be combined. For example, a cartridge case may be coated with a durable, non-visible ink or other coating and a product identifier etched into the coating. The discharge of the cartridge would then result in the imprinting or embossing of a firearm identification Encoded Multi-Dimensional Indicia (EMDI) 114 into the material of the cartridge case or into the coating by removing further areas of the coating.

Next considering the reading of Encoded Multi-Dimensional Indicia (EMDI) 114 such as Encoded Holograms 114EH or Encoded concentric Circular Barcodes (ECCBs) 114EC, an example of an Indicia Imaging Apparatus 82 suitable for reading Encoded Multi-Dimensional Indicia (EMDI) 114 has been described herein above with respect to FIGS. 7, 8 and 9 and, as such, need be discussed in further detail. It will be noted, however, that the described Indicia Imaging Apparatus 82 may be further adapted for the specific characteristics of Encoded Multi-Dimensional Indicia (EMDI) 114. For example, Optical Magnifying Mechanism 84 may incorporate one or more filters suitable spectral domains of observation and the specific radiation used to illuminate the Encoded Multi-Dimensional Indicia (EMDI) 114, such as color filters, polarizing filters or holographic filters. Illuminator 94, in turn, may be constructed as a ring light source, that is, a light source radiating from the circumference of a ring surrounding the image area, and may employ, for example, mono-chromatic light sources or diode lasers. Illuminator 94 may also be implemented to provide radiation adapted and matched to the Encoded Multi-Dimensional Indicia (EMDI) 114, such as infrared, ultraviolet, colored visible frequencies, polarized radiation, and other specific wavelengths of light, or combinations thereof, or may include elements for generating, for example, magnetic fields for magneto-sensitive or activated materials. The light sources implemented in an Illuminator 94 may therefore include, for example, lamps or laser or LED sources, with or without filters of various types, which emit radiation in a frequency range and of a type suitable to make the Encoded Multi-Dimensional Indicia (EMDI) 114 visible to a viewer, scanner or camera.

Figure 12:
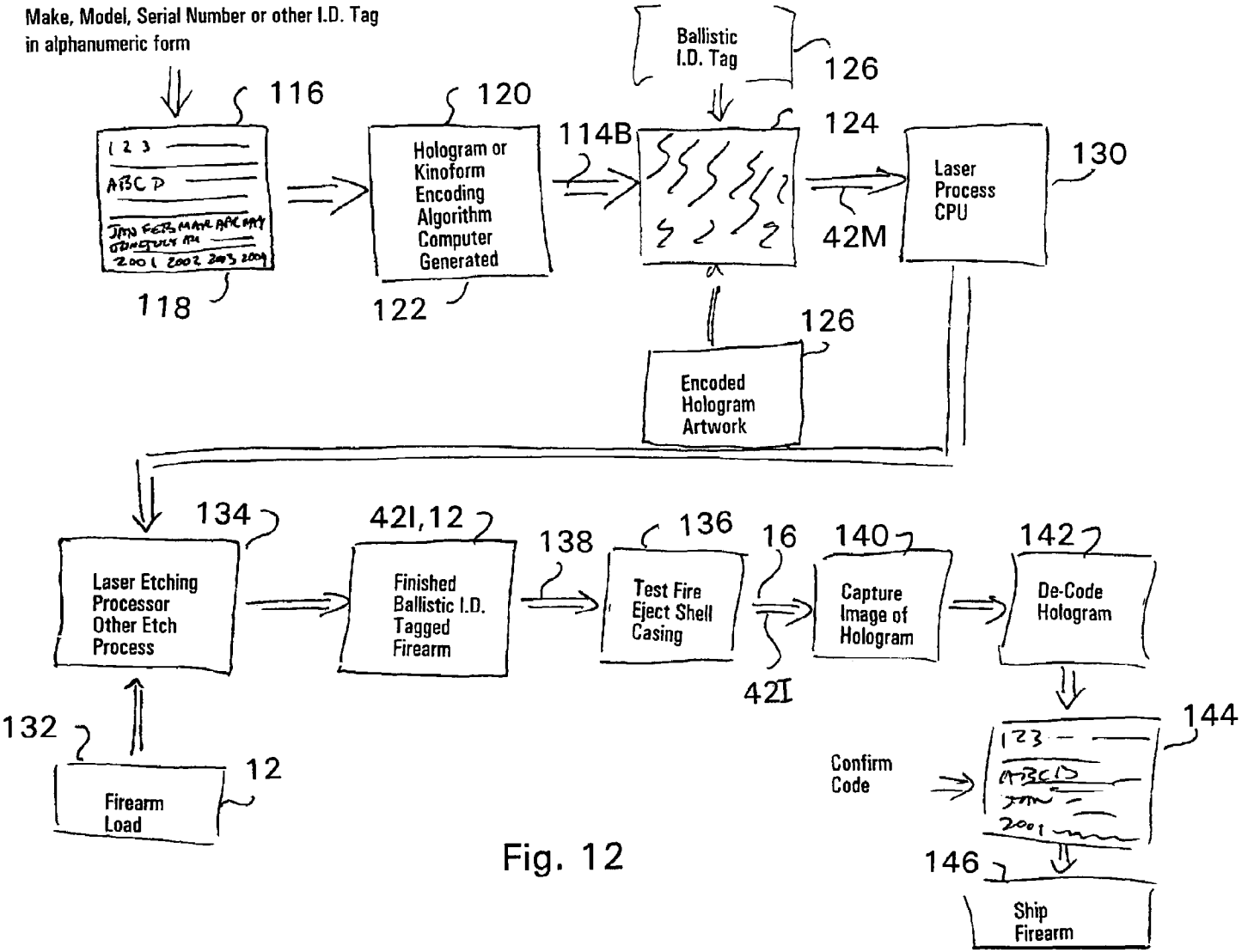
FIG. 12 is a diagram of the marking of a firearm with an multi-dimensional encoded indicia.

Referring now to FIG. 12, therein is illustrated the process for imprinting an Encoded Multi-Dimensional Indicia (EMDI) 114 on or in a surface, such as a chambre, ramp or bolt face of a firearm, the impact face a firing pin or a bearing surface of an extractor. As shown therein, in Step 116 Product Information 118 is compiled and, in Step 120, encoded by means of, for example, a hologram or kinoform Encoding Algorithm 122 to generate a Base Encoded Multi-Dimensional Indicia (EMDI) 114B. In Step 124, the Base Encoded Multi-Dimensional Indicia (EMDI) 114B is compiled together with a Ballistic Identifier Tag 126, that is, a unique Firearm 12 identification code, and Encoded Hologram Artwork 126 to generate a Marking Indicia 42M filed comprised of the Encoded Multi-Dimensional Indicia (EMDI) 114. The Marking Indicia 42M file is sent to a Laser Process System 130, such as an Image Imprinting System 56, and in Step 132 the Firearm 12, a component of a Firearm 12, such as a Bolt 50, or a Marking Insert 54 is loaded to the Laser Process System 130, which performs the Laser Etch Process 134 to imprint the Marking Indicia 42M on the Firearm 12, the component thereof, or the Marking Insert 54. In Step 136 the Finished Firearm 138 may be test fired to obtain an expended and ejected Cartridge Case 16 marked with the Identifying Indicia 42I and, in Step2 140, 142 and 144 the Encoded Multi-Dimensional Indicia (EMDI) 114 captured, decoded and confirmed, whereupon in Step 146 the Firearm 12 may be released for shipment.

Figure 9:
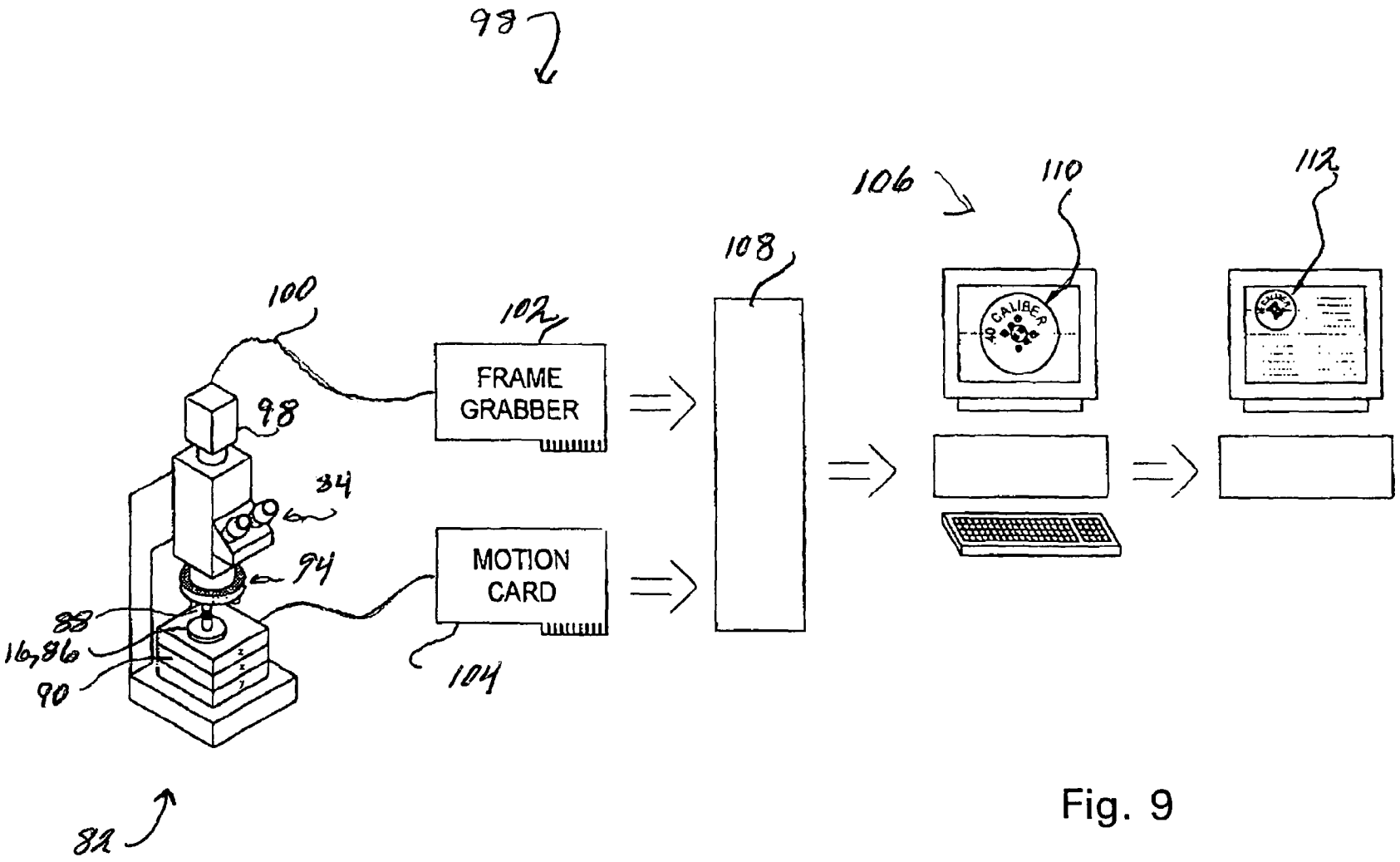

Lastly referring to FIGS. 13A and 13B, therein are illustrated a hand-held, portable EHMDB Reading Device 148, which is essentially comprised of the elements, components and functions described herein above with regard to Indicia Imaging Apparatus 82 and Image Processing System 106 as illustrated in FIGS. 7, 8 and 9, and a diagrammatic cross section side view of the EHMDB Reading Device 148.

Figure 13A:
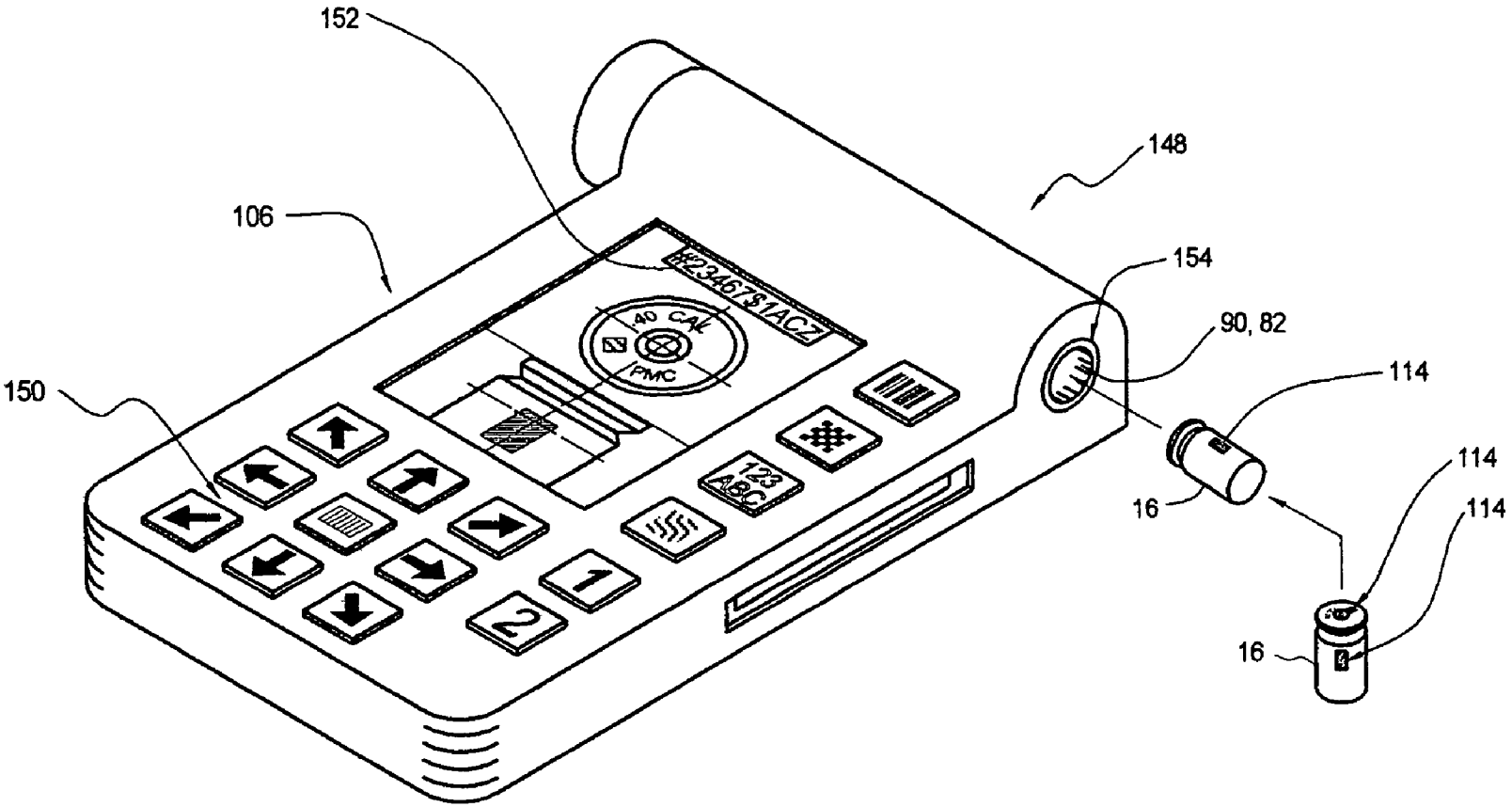
FIGS. 13A and 13B a diagrammatic representations of a self-contained reader for reading a multi-dimensional encoded indicia from a cartridge case.

As shown in FIG. 13A, the Indicia Imaging Apparatus and Image Processing System 106 are essentially packaged into the casing of EHMDB Reading Device 148, which further includes a Control Panel 150 for controlling the functions and operations of the EHMDB Reading Device 148, a Display 152 for displaying either or both of any Identifying Indicia 42I located on either a cartridge casing wall or a cartridge casing base or the primer in the cartridge case base and the decoded and translated information encoded in the Encoded Multi-Dimensional Indicia (EMDI) 114. As also shown, the EHMDB Reading Device 148 includes a Specimen Port 154 for receiving and holding a Cartridge Case 16 to be inspected, with illumination sources, optical imaging elements and image capture elements arranged therein to scan and capture Encoded Multi-Dimensional Indicia (EMDI) 114 images from the surfaces of the Cartridge Case 16. The Specimen Port 154 of the EHMDB Reading Device 148 will preferably include a Specimen Mounting Device 90 capable of receiving, for example, a Cartridge Case 16 base end first and of holding and positioning the Cartridge Case 16, either manually or automatically, so that all surfaces of interest of the Cartridge Case 16 may be scanned by one or more imaging systems and elements therein.

Figure 13B:
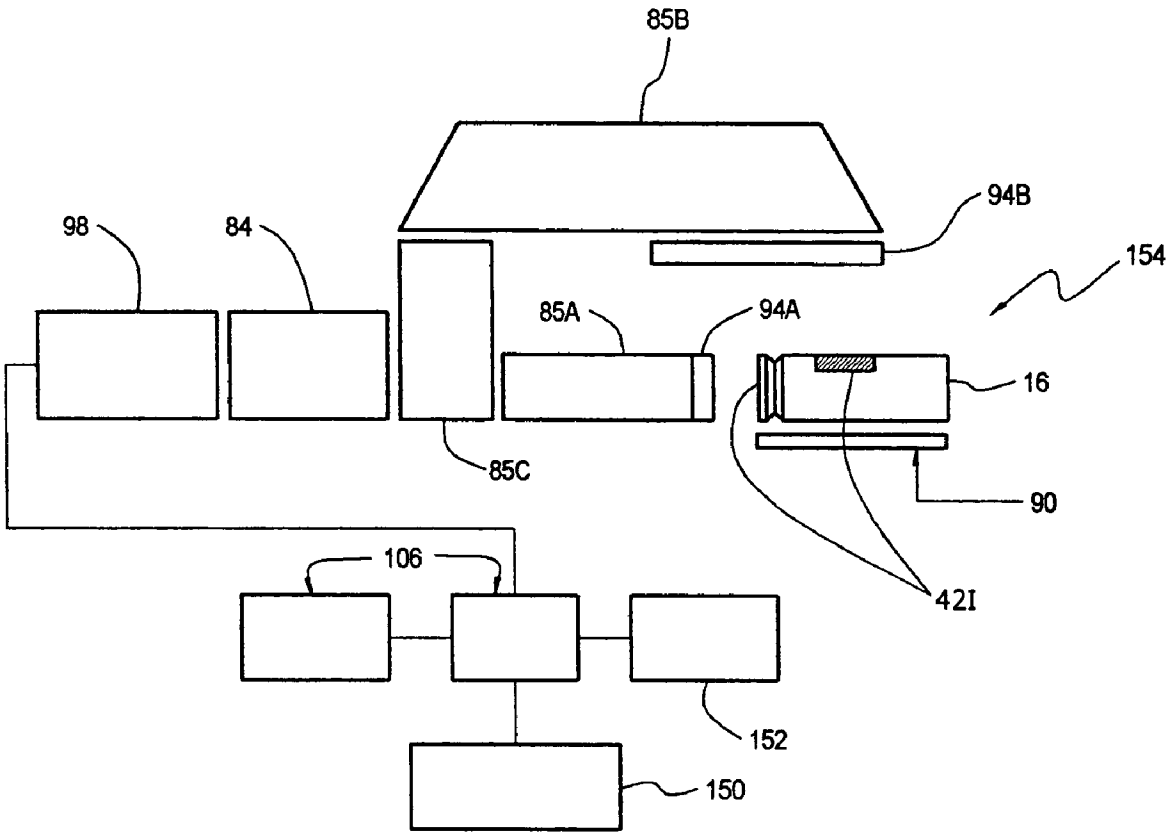

FIG. 13B illustrates an exemplary arrangement of the interior components of a EHMDB Reading Device 148. As shown, an EHMDB Reading Device 148 typically includes a Processing System 10, Display 152 and Control Panel 150, which occupy the main section of the body or casing of the EHMDB Reading Device 148, with the optical elements occupying the spaces interior to the Specimen Port 154.

As shown, a Cartridge Case 16 may be inserted into Specimen Port 154, typically base first, and is retained and manipulated by a Support Device 90 which is preferably adaptable to different sizes of Cartridge Case 16 by means of adaptable or adjustable restraining members (not shown). Base 22 and Sidewall 16W of the Cartridge Case 16 are viewed through separate optical paths wherein Base 22, which will be in a relatively fixed position when the Cartridge Case 16 is held in Support Mechanism 90, is view through Axial Optical Elements 85A. As indicated, a ring Illuminator 94A surrounding the optical path from Axial Optical Elements 85A and Base 22 may be located along the axial optical viewing path for optimum controllable illumination of Base 22 and the Axial Optical Elements 85A and Illuminator 94A may also include various forms of filters. Illuminator 94A may also be adjustable with regard to the illuminating radiation and perhaps the angle of incidence of the illumination on Base 22.

A radial optical path for viewing of Sidewall 16W is illustrated as including a Prism Element 85B, which turns the radial viewing path through two right angles so that an image of Sidewall 16W is routed to an Optical Element 85C, which combines axial viewing path through Axial Optical Elements 85A and Prism Element 85B to form a single viewing path through an Optical Magnifying Mechanism 84 and to an Image Capture Device 98, which has been previously discussed. A second Illuminator 94B similar to Illuminator 94A is associated with Prism Element 85B to provide the appropriate illumination on Sidewall 16W, and various forms of filters may be interposed in the optical path through Prism Element 85B.

F. Summary of the Creation and Reading of Encoded Multi-Dimensional Indicia

In summary, therefore, an Encoded Multi-Dimensional Indicia 42 may be marked upon any suitable object, whether a firearm, a discharged cartridge case, a product of some form, a security badge or tag, for the purpose of representing selected information. An Encoded Multi-Dimensional Indicia 42 of the present invention is comprised of a multi-dimensional array of encoded marks, which include encoded marks determined by spectral encoding variables representing the selected information wherein each spectral variable being spectrally distinguishable from others of the spectral variables representing variables, and an encoded pattern of the encoded marks determined by an algorithmic transformation of the selected information.

In typical embodiments, an Encoded Multi-Dimensional Indicia 42 may be embodied as a multi-dimensional encoded hologram or as an encoded concentric circular barcode wherein, in particular, a concentric circular barcode comprises an array of concentric ring patterns wherein each ring pattern is a circular based intensity encoding of a corresponding information item. Examples of spectral encoding variables, each of which is selected as having a unique effect in determining the encoded pattern of marks, could include a wavelength of radiation used in encoding the hologram and a working distance of the hologram, and the selected information may be encoded by any of binary phase Fourier, DOE, CGH, Lohmann, Lee, Fourier, Fraunhofer, Fresnel and kinoform type of hologram encoding algorithms. Encoded Multi-Dimensional Indicia 42 may also be comprised of a plurality of spectrally distinguishable layers superimposed on a surface of an object, and a first layer of the indicia may be formed in a surface material of the object by one of removal of selected areas of the surface material and by physical impact of a marking indicia that is an inverse image of the indicia.

Figure 14A:
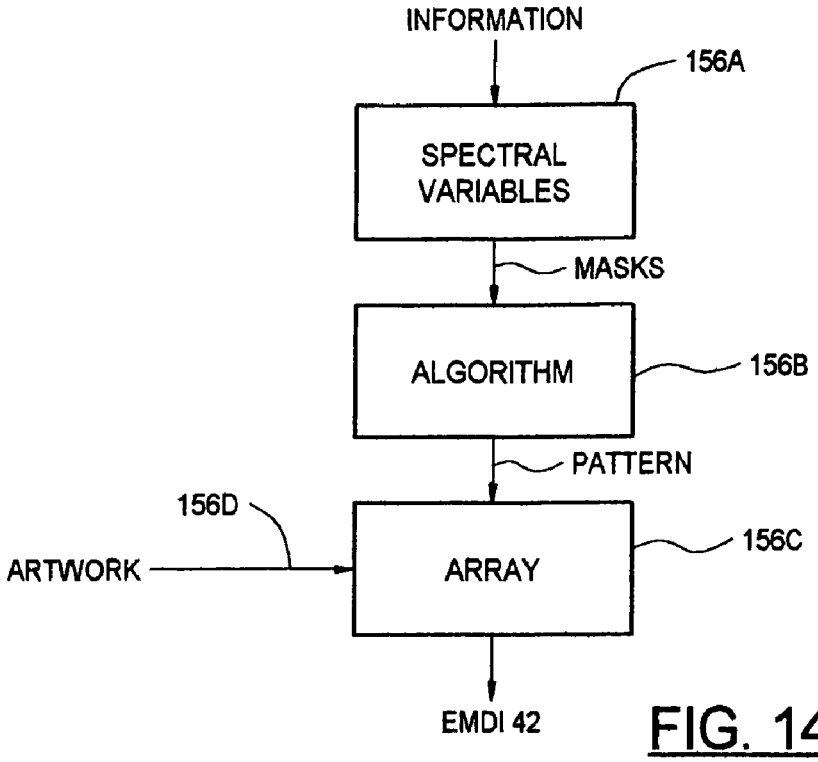
FIGS. 14A and 14B is diagrams of the creation and reading of a multi-dimensional encoded indicia; and, FIGS. 15A, 15B and 15C are diagrammatic representations of marking arrays on a firearm surface for increasing the probability of imprinting of an identification indicia.

As illustrated in FIG. 14A, Encoded Multi-Dimensional Indicia 42 are created by (Step 156A) generating a multi-dimensional array of encoded marks forming an encoded pattern as determined by (Step 156B) an algorithmic transformation of the selected information wherein each encoded mark is (Step 156C) determined by spectral encoding variables representing the selected information, and wherein each spectral variable is spectrally distinguishable from the other spectral variables. The process may also include (Step 156D) the conjoining of an algorithm related artwork with the encoded pattern.

Figure 14B:
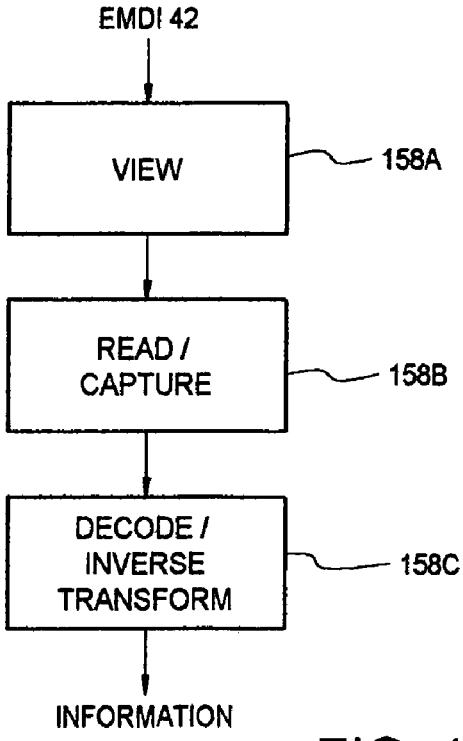

The reading of Encoded Multi-Dimensional Indicia 42, as illustrated in FIG. 14B, is essentially a reverse transform of the creation process, and includes (Step 158A) viewing the encoded multi-dimensional indicia according to at least one spectral encoding variable, wherein each spectral encoding variable corresponds to a spectral encoding variable employed in creating the encoded multi-dimensional indicia, Step (158B) reading an encoded pattern representing a multi-dimensional array of encoded marks represented the selected information, and (Step 158C) decoding the encoded pattern of encoded marks with an inverse algorithmic transform of an algorithmic transformation employed in generating the encoded pattern from the selected information.

G. Multiple Indicia Marking

It has been described herein above that ballistic finger prints and scratch and ding markings, while traditionally the most useful and most used for identifying a given, specific firearm, are, however, pseudo-repeatable and largely random and non-specific in nature. These characteristics of ballistic finger prints and scratch and ding markings arise because the "scratches and dings" are largely formed by random irregularities in the surfaces of a firearm and by largely random impacts or pressure points between the surfaces of the cartridges and the firearms.

For this reason, the present invention addresses the methods and mechanisms for forming and reading Indicia 42 to provide consistent, unique, and repeatable identification markings; that is, and in many respects, to replicate "scratch and ding" markings, but in a more reliable, repeatable and unique form. As described, the methods and mechanisms of the present invention include various forms of Indicia 52, including Encoded Multi-Dimensional Indicia 42, and various systems and methods for etching or otherwise forming Indicia 42 on a surface of a firearm and subsequently reading such Indicia 42.

It must be noted, however, that under certain circumstances the Identification Indicia 42I of the present invention may not be properly formed. For example, many Identification Indicia 42I are formed by the striking or pressing of a single Marking Indicia 42M on a surface of a cartridge and distortion or deformation of the cartridge case may cause the Marking Indicia 42M to "miss" the cartridge surface. In other instances, the imprint may be blurred, incompletely formed or distorted by, for example, dirt, grease, scratches or abrasions on the cartridge surface, or the possessor of the firearm may have sought to locate and remove or mutilate the Marking Indicia 42M.

The present invention provides various forms of the Marking Indicia 42M and Identification Indicia 42I and various methods of forming the Identification Indicia 42I that address these problems. For example, the Encoded Multi-Dimensional Indicia 42 of the present invention are advantageous in dealing with distorted, deformed, blurred, or incompletely formed Identification Indicia 42I, and with at least some attempts to destroy the Marking Indicia 42M.

According to a present aspect of the present invention, however, such issues may be advantageously addressed by adapting or adopting certain aspects of replicate "scratch and ding" markings, but in a more reliable, repeatable and unique form. For example, "scratch and ding" markings may occur anywhere on a given surface of a firearm and in certain instances may cover or effectively cover an entire surface or a large proportion of a surface, such as machining markings left on a Bolt Face 50. This, in turn, significantly increases the probability that at least some identifiable corresponding "scratch and ding" markings will be formed on a surface of a cartridge case. As discussed, however, reliance on random "scratch and ding" markings is unsatisfactory because the resulting "identification marks", or " ballistic fingerprints", are pseudo-repeatable and largely random and non-specific. In contrast, the Indicia 42 of the present invention provide consistent, unique, and repeatable identification markings. An object of the following embodiment of the present invention is to increase the probability that one or more useable Identification Indicia 42I will be marked on a Cartridge Case 16 by operation of the firearm firing the Cartridge Case 16, despite such random factors such as the cartridge feeding, seating or ejecting at an unexpected angle, irregularities in the surface of the cartridge, or other random or deliberate factors, such as dirt, grease or attempts to mutilate or obscure the Marking Indicia 42M.

Figure 15A:
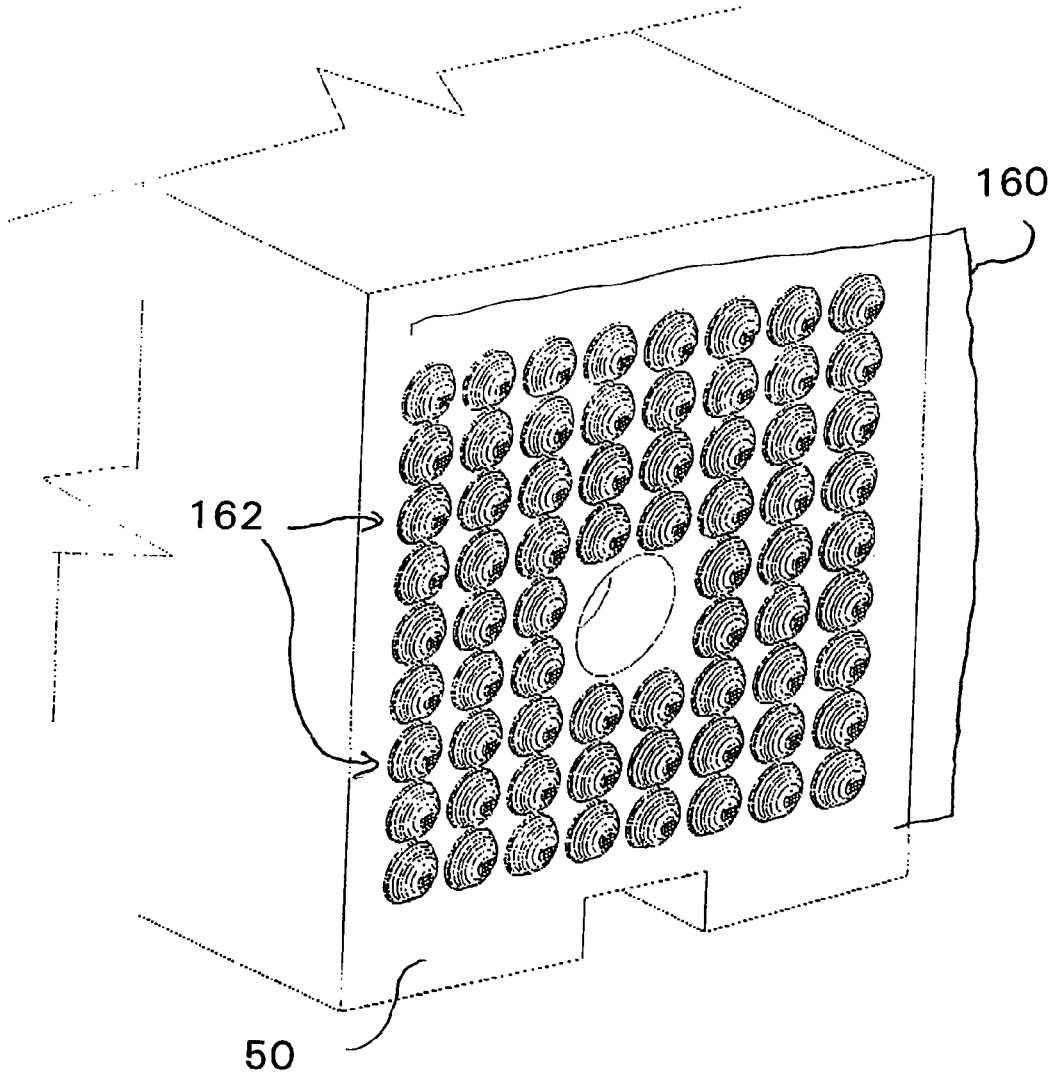
Figure 15B:
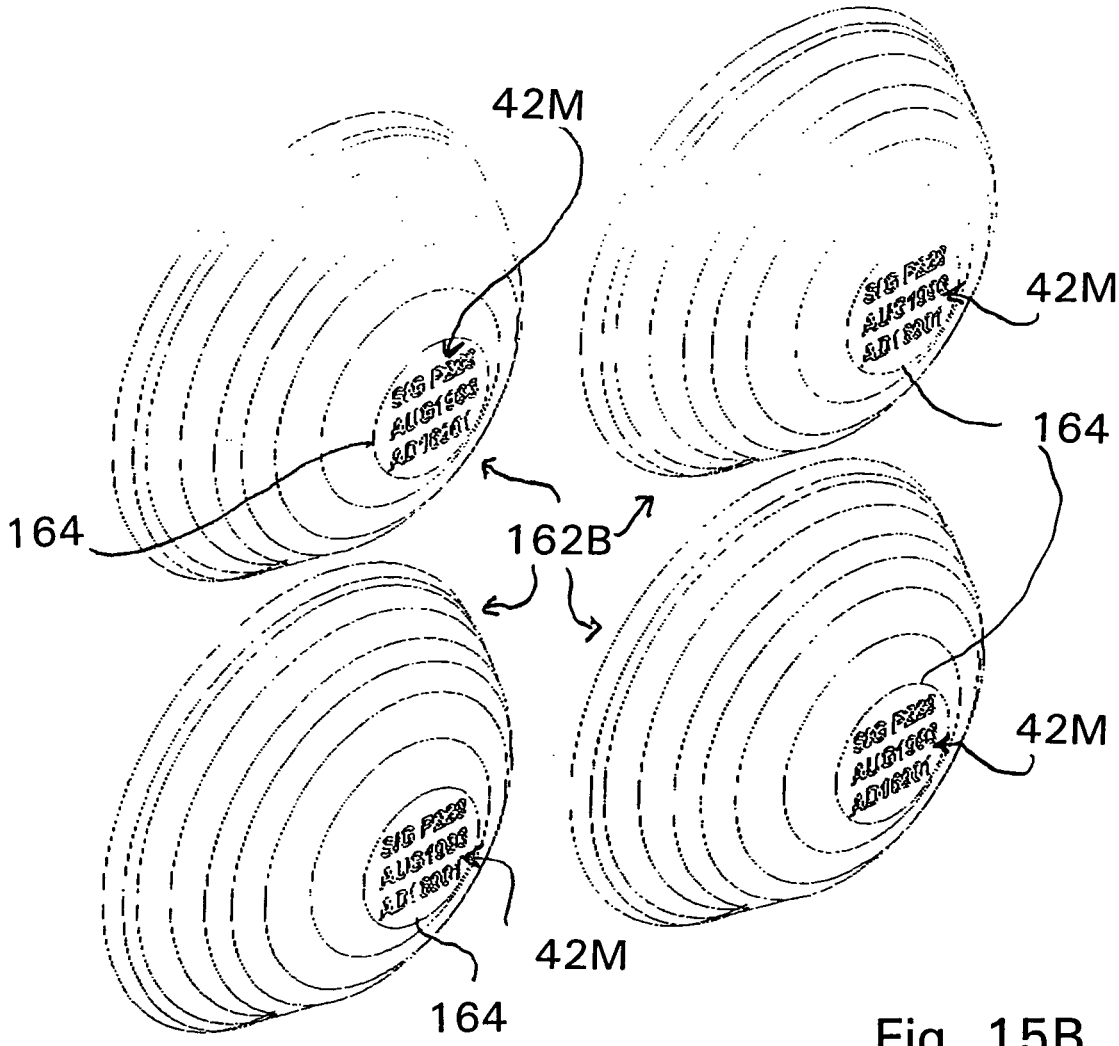
Figure 15C:
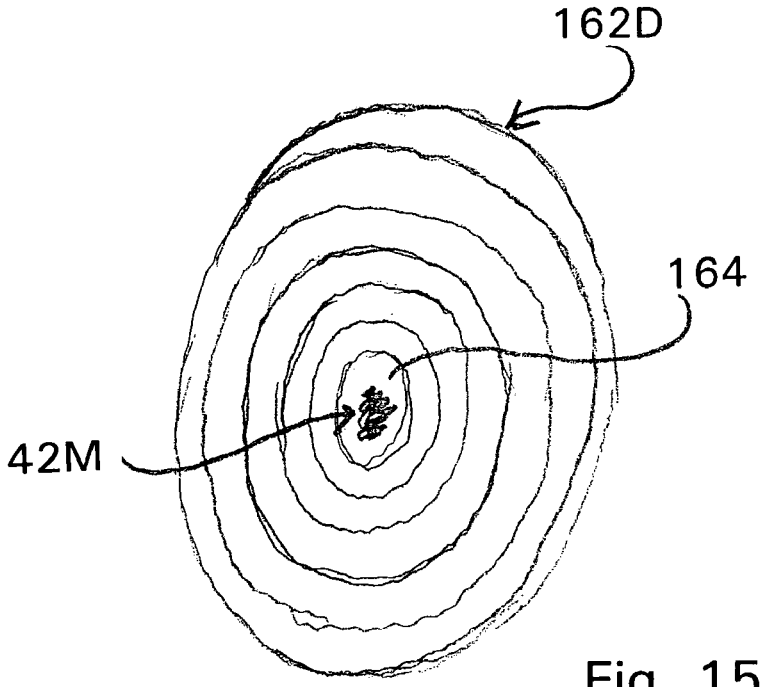

Referring to FIGS. 15A, 15B and 15C, therein are illustrated an embodiment of the present invention to enhance the probability that a usable Identification Indicia 42I will be marked on a surface of a Cartridge Case 16, such as the Base 22. The exemplary Firearm 12 surface shown in FIGS. 15A and 15B is a Bolt Face 50, but may be virtually any other surface capable of bearing Marking Indicia 42M and of imprinting the Marking Indicia 42M on a surface as an Identification Indicia 42I.

As shown in FIG. 15A, Bolt Face 50 is provided with a Marking Array 160 of Marking Elements 162 wherein, as illustrated in FIG. 15B, a Marking Element 162 may be a Marking Boss 162B wherein each Marking Boss 162B is a generally conical or hemispherical convex protrusion from Bolt Face 50 and bears a Marking Indicia 42M of any of the types discussed herein above on an outer, central Striking Face 164. In alternate embodiments, as illustrated in FIG. 15C, Marking Elements 162 may be comprised of Marking Dimples 162D, each of which is a concave depression of a generally conical or hemispherical shape having a centrally located Striking Face 164 bearing a Marking Indicia 42M.

As will be readily seen, the contact of a Bolt Face 50 having a Marking Array 160 with the Base 22 of a Cartridge Case 16 will result in the Marking Indicia 42M of at least one and usually a plurality of either of Marking Bosses 162B or Marking Dimples 16D imprinting corresponding Identification Indicia 42I on the Base 22 surface. It will also be apparent that, due to the number and distribution of Marking Bosses 162B or Marking Dimples 162D on the Bolt Face 50, there will be a corresponding high probability that at least one Identification Indicia 42I will be imprinted on the surface of the Cartridge Case 16. It will be further apparent that a Marking Array 160 may be formed on any surface of a Firearm 12 that is capable of bearing a plurality of Marking Bosses 162B or Marking Dimples 162D, and that one or more Identification Indicia 42I will be imprinted despite a wide range of angles or placements of the striking surface with respect to the cartridge case surface and despite a wide range of conditions of either or both of the striking surface or the cartridge case surface.

Since certain changes may be made in the above described method and system, without departing from the spirit and scope of the invention herein involved, it is intended that all of the subject matter of the above description or shown in the accompanying drawings shall be interpreted merely as examples illustrating the inventive concept herein and shall not be construed as limiting the invention.

We claim:

1. A method for marking an identification indicia representing selected identification information on a cartridge case during the process of discharging the cartridge in a chamber of a firearm, comprising the steps of:

locating a marking indicia on a marking surface of the firearm chamber contacting a surface of the cartridge case, with the marking indicia being a hologram image representing a multi-dimensional array of encoded marks representing the selected identification information encoded by a spectral variable; and during the process of discharging the cartridge, imprinting the marking indicia into the surface of the cartridge case to be the identification indicia by mutual contact between the marking surface and the surface of the cartridge case.

2. The method of claim 1 wherein the identification indicia is imprinted in the surface of the cartridge case by physical impression of the marking indicia and wherein the marking indicia is an inverse image of the identification indicia.

3. The method of claim 2 wherein the marking surface is a surface of the chamber of the firearm.

4. The method of claim 1 for marking an identification indicia representing selected identification information on a cartridge case during the process of discharging the cartridge in a chamber of a firearm, further including the method for creating the marking indicia on the marking surface, comprising the steps of:

generating the multi-dimensional array of encoded marks representing the selected identification information wherein each encoded mark is determined by spectral encoding variables representing the selected information, and each spectral variable is spectrally distinguishable from others of the spectral variables representing variables, forming an encoded pattern of the encoded marks by an algorithmic transformation of the encoded marks representing the selected information, and forming a hologram image of the encoded pattern on the marking surface as the marking indicia.

5. The method of claim 4 wherein a spectral encoding variable is one of a wavelength of radiation used in encoding a hologram and a working distance of a hologram.

6. The method of claim 1 for marking an identification indicia representing selected identification information on a cartridge case during the process of discharging the cartridge in a chamber of a firearm, further comprising a method for reading an identification indicia on the surface of the cartridge case, comprising the steps of:

viewing the identification indicia according to at least one spectral encoding variable, wherein each spectral encoding variable corresponds to a spectral encoding variable employed in creating the encoded multi-dimensional marking indicia, reading an encoded pattern representing a multi-dimensional array of encoded marks represented the selected identification information, and decoding the encoded pattern of encoded marks with an inverse algorithmic transform of an algorithmic transformation employed in generating the encoded pattern of the marking indicia from the selected identification information.

7. The method of claim 6 for reading an identification indicia wherein at least one step of viewing the identification according to a spectral encoding variable includes viewing the indicia with a corresponding filter.

* * * * *